US005301523A

United States Patent [19]

Payne et al.

[11] Patent Number: 5,301,523

[45] Date of Patent: Apr. 12, 1994

[54] ELECTRONIC WASHER CONTROL INCLUDING AUTOMATIC BALANCE, SPIN AND BRAKE OPERATIONS

[75] Inventors: Thomas R. Payne; Steven A. Rice; Richard E. McKnight, Jr.; William W. Wead, all of Louisville, Ky.

[73] Assignee: General Electric Company, Louisville, Ky.

[21] Appl. No.: 936,012

[22] Filed: Aug. 27, 1992

[51] Int. Cl.[5] ..... D06F 33/02

[52] U.S. Cl. ..... 68/12.16; 68/23.7; 318/368; 318/376

[58] Field of Search ..... 318/368, 376; 68/12.16, 68/23 R, 23.7

[56] References Cited

U.S. PATENT DOCUMENTS

| | | | |
|---|---|---|---|
| 3,931,553 | 1/1976 | Stich et al. | 318/138 |
| 3,947,740 | 3/1976 | Tsuboi | 318/376 |
| 4,250,435 | 2/1981 | Alley et al. | 318/138 |
| 4,329,630 | 5/1982 | Park | 318/258 |
| 4,857,814 | 8/1989 | Duncan | 318/138 X |
| 4,916,370 | 4/1990 | Rowan et al. | 318/368 |

FOREIGN PATENT DOCUMENTS

| | | |
|---|---|---|
| 0335790 | 10/1989 | European Pat. Off. . |
| 2260547 | 4/1993 | United Kingdom . |

*Primary Examiner*—Philip R. Coe
*Attorney, Agent, or Firm*—H. Neil Houser

[57] ABSTRACT

A fabric washing machine includes a container to receive fabrics and fluid to wash the fabrics. A switched reluctance motor is operatively connected to oscillate and rotate the container. A control operates the machine by providing commutation signals to the motor to energize the stator phases in a predetermined sequence as corresponding rotor phases approach the stator phase being energized. To stop the machine the control repeatedly senses the instantaneous alignment of the stator and rotor phases and supplies commutation signals to the motor to energize the stator phases in the same sequence but as corresponding rotor phases have become aligned with the stator phase being energized.

4 Claims, 27 Drawing Sheets

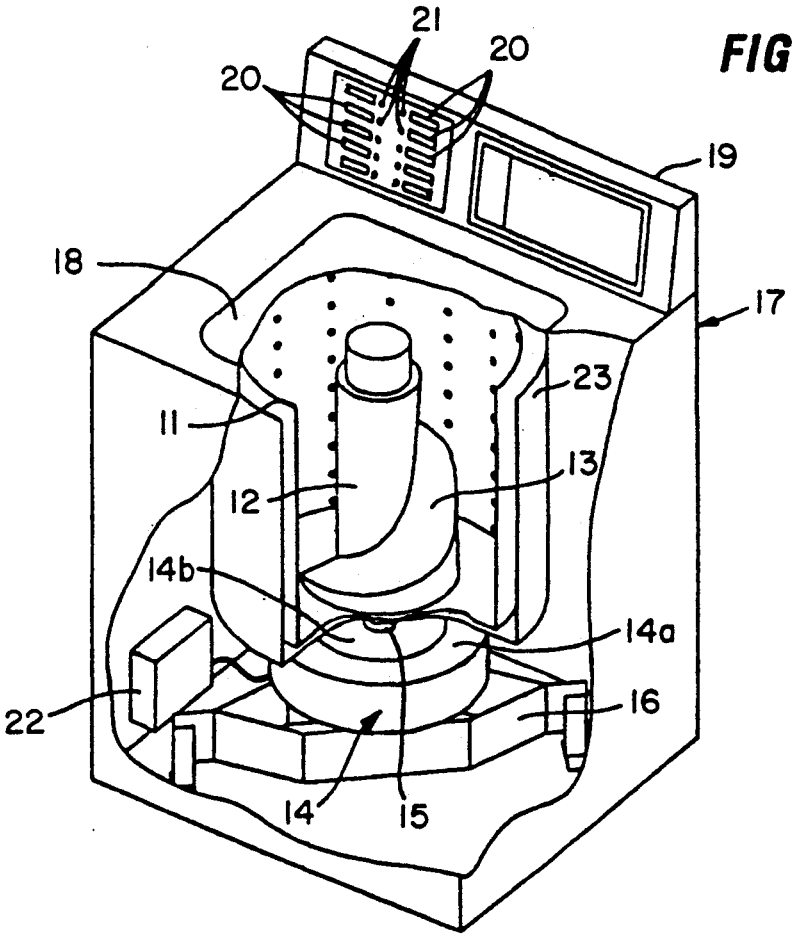
FIG. 1
FIG. 2
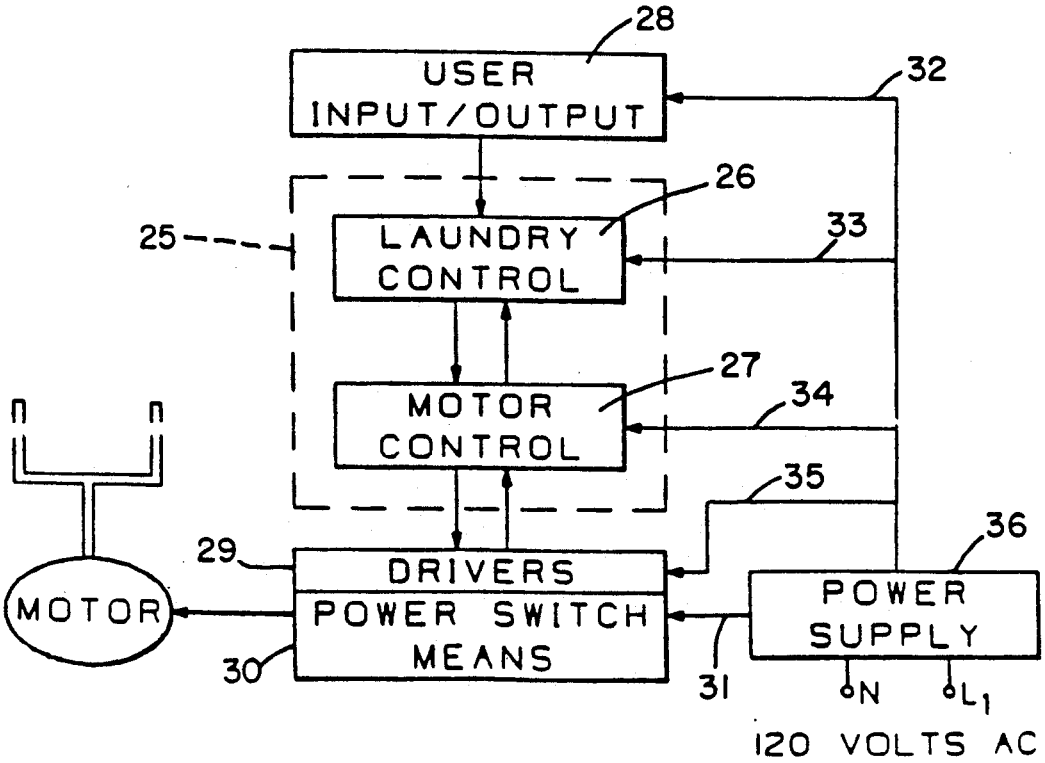

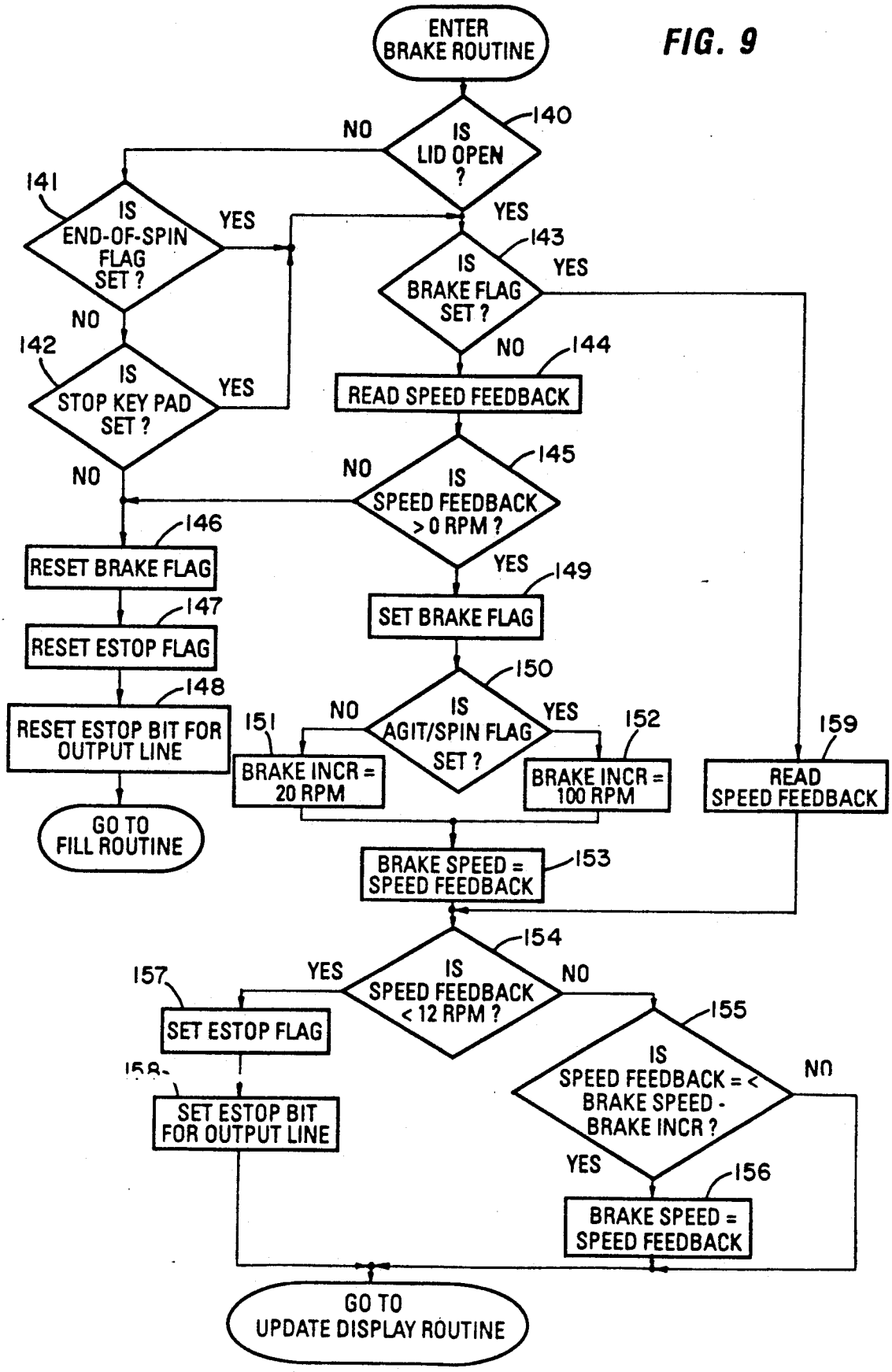
ENTER BRAKE ROUTINE
FIG. 9
140
IS LID OPEN ?
NO
YES
141
IS END-OF-SPIN FLAG SET ?
YES
NO
142
IS STOP KEY PAD SET ?
YES
NO
143
IS BRAKE FLAG SET ?
YES
NO
144
READ SPEED FEEDBACK
145
IS SPEED FEEDBACK > 0 RPM ?
NO
YES
146
RESET BRAKE FLAG
147
RESET ESTOP FLAG
148
RESET ESTOP BIT FOR OUTPUT LINE
GO TO FILL ROUTINE
149
SET BRAKE FLAG
150
IS AGIT/SPIN FLAG SET ?
NO
YES
151
BRAKE INCR = 20 RPM
152
BRAKE INCR = 100 RPM
159
READ SPEED FEEDBACK
153
BRAKE SPEED = SPEED FEEDBACK
154
IS SPEED FEEDBACK < 12 RPM ?
YES
NO
157
SET ESTOP FLAG
158
SET ESTOP BIT FOR OUTPUT LINE
155
IS SPEED FEEDBACK = < BRAKE SPEED - BRAKE INCR ?
NO
YES
156
BRAKE SPEED = SPEED FEEDBACK
GO TO UPDATE DISPLAY ROUTINE

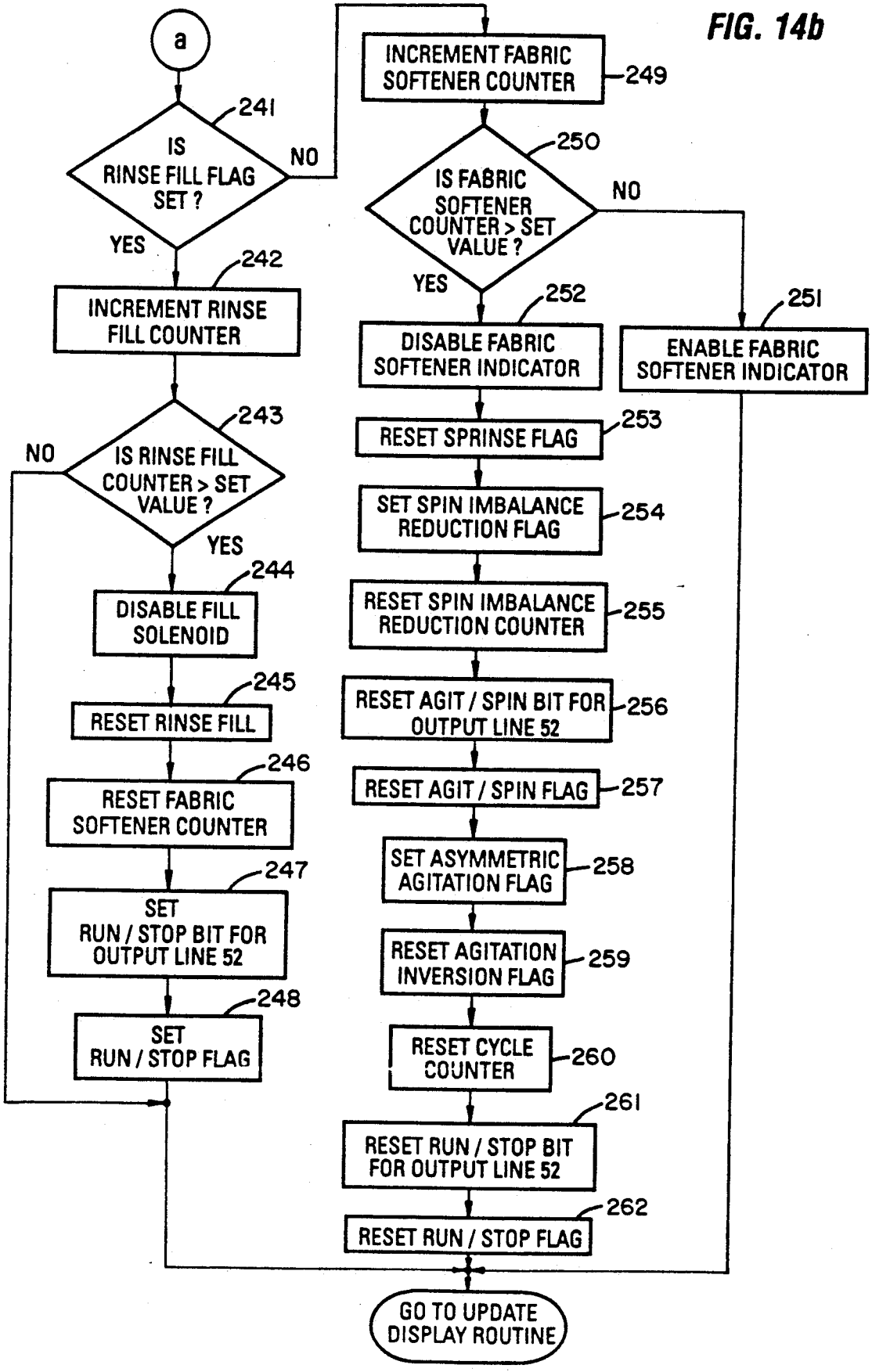
FIG. 14b
a
IS RINSE FILL FLAG SET ?
241
NO
YES
INCREMENT RINSE FILL COUNTER
242
IS RINSE FILL COUNTER > SET VALUE ?
243
NO
YES
DISABLE FILL SOLENOID
244
RESET RINSE FILL
245
RESET FABRIC SOFTENER COUNTER
246
SET RUN / STOP BIT FOR OUTPUT LINE 52
247
SET RUN / STOP FLAG
248
INCREMENT FABRIC SOFTENER COUNTER
249
IS FABRIC SOFTENER COUNTER > SET VALUE ?
250
NO
YES
DISABLE FABRIC SOFTENER INDICATOR
252
ENABLE FABRIC SOFTENER INDICATOR
251
RESET SPRINSE FLAG
253
SET SPIN IMBALANCE REDUCTION FLAG
254
RESET SPIN IMBALANCE REDUCTION COUNTER
255
RESET AGIT / SPIN BIT FOR OUTPUT LINE 52
256
RESET AGIT / SPIN FLAG
257
SET ASYMMETRIC AGITATION FLAG
258
RESET AGITATION INVERSION FLAG
259
RESET CYCLE COUNTER
260
RESET RUN / STOP BIT FOR OUTPUT LINE 52
261
RESET RUN / STOP FLAG
262
GO TO UPDATE DISPLAY ROUTINE

WET LOAD SIZE

| IMBALANCE MEASUREMENT | MINI & SMALL | MEDIUM & LARGE |
|---|---|---|
| UPPER THRESHOLD | MAX. | MAX. |
| LOWER THRESHOLD | 300 RPM | 200 RPM |
| | 250 RPM | 150 RPM |

ELECTRONIC WASHER CONTROL INCLUDING AUTOMATIC BALANCE, SPIN AND BRAKE OPERATIONS

FIELD OF THE INVENTION

This invention relates to laundry apparatus or automatic washing machines and more particularly to a washing machine control which operates the machine to automatically balance the load of fabrics to be spun at a high velocity, determine the extent of any imbalance present in the load of fabrics, adjust the terminal spin speed based upon the extent of the imbalance, and brake the rotating basket in a controlled manner.

BACKGROUND OF THE INVENTION

Clothes washing machines commonly extract water from the clothes (fabrics) by revolving a perforated container or basket containing the fabrics at a high rotational velocity. Centrifugal forces pull the majority of the water out of the cloth fibers and through the holes in the rotating basket. The water is removed from the machine by means of a pump and/or drain arrangement. The rotating basket is supported by a suspension system designed to dampen translational motion induced by any imbalance within the rotating basket. High stresses are encountered within the basket, drive system, and suspension system during the high speed spin action used for water extraction during normal wash cycles. With an imbalance within the load, the normal force is generated which is proportional to the product of the mass, the distance between the imbalance and the center of rotation, and the square of the velocity. Small imbalances can very easily generate large forces as a result of the high rotational velocities. In accordance with one aspect of the present invention, the size of the imbalance, and thereby the forces acting upon the rotational system, are minimized.

It is well known for a washing machine to employ a sensor to determine if the machine is operating with an unbalanced load. If an unbalanced load is detected during an extraction spin cycle, the machine is stopped and a signal is generated to alert the user to the unbalanced load. Another common method of dealing with an unbalanced load is to design the drive system of the washer so that an unbalanced load will require greater torque to reach terminal spin velocity than what is available. Since the torque output of the motor is fixed, the load never reaches terminal spin velocity. The spin velocity is thus adjusted, via a slip mechanism in the drive system, to a lower value.

The sensor approach has the advantage of being able to alert the consumer to an unbalanced condition. If the consumer rebalances each load that is detected as being unbalanced, every load will spin at full speed. However, the disadvantages to the sensor scheme far outnumber the benefits. If the user is not aware of the unbalanced condition, the load in the basket will remain saturated. Imbalance sensors have also been shown to produce unnecessary service (repair) calls. A user finding the machine stopped with a load of saturated clothes, may call for service when all that is needed is for the fabrics to be redistributed and the machine restarted. A further drawback of an imbalance sensor is the cost of the sensor itself. With increasing material consciousness, the addition of a sensor for a function that can be implemented without a sensor is difficult to justify. In accordance with another aspect of the present invention an imbalance present in the wash load of fabrics is detected and the terminal spin speed is adjusted to an appropriate level without the need for an imbalance sensor or a slip mechanism in the washing machine.

Spin control is accomplished using a set of algorithms. An additional algorithm is employed for controlled braking of the rotating clothes basket. It is advantageous that the rotating mechanisms of a washing machine be stopped quickly when the lid is opened. For example, Underwriter's Laboratory requires, that the rotating mechanisms within a washing machine reach a full stop within seven seconds of opening the lid. Current production washers typically meet this requirement with a friction type brake contained within the transmission housing. When the lid is raised, the power supply to the motor is interrupted and the brake engaged. The result is an abrupt halt in the rotational action. The mechanical brake has proven itself effective; however, new washer designs have eliminated the transmission and, indirectly, the mechanical brake. Since these designs must conform to the same stopping requirements as prior mechanically braked washers, the brake function must be implemented other than by us of the transmission. The motor may be constructed to contain a mechanical brake or an external brake could be placed around the motor drive shaft. Each of these approaches adds cost and complexity to the machine. In accordance with one aspect of the present invention rotating components are braked by electronically controlling the motor, without the addition of mechanical hardware.

A direct drive oscillating basket washing machine and associated of the type of the exemplification machine and control are disclosed in U.S. Pat. No. 5,076,076, issued to Thomas R. Payne on Dec. 31, 1991, and assigned to General Electric Company, assignee of the present invention; which patent is included herein by reference.

SUMMARY OF THE INVENTION

In accordance with certain embodiments of this invention, the size of the imbalance within the wash load is minimized, the extent and nature of any remaining imbalance is determined, the terminal spin speed is adjusted in accordance with the remaining imbalance and the rotating action of the machine is braked in a controlled manner at the conclusion of the extraction operation (or in the event the machine lid is opened).

In accordance with one aspect of the invention, the machine redistributes the wash load to minimize the unbalance of the fabric load by employing an operation sequence executed upon the completion of the agitation phase of the wash cycle and before the commencement of the spin phase of the wash cycle.

The load unbalance is minimized by use of an asymmetrical agitation operation in the presence of water to redistribute the fabrics evenly throughout the basket. Following a brief period of the asymmetrical agitation, the water is pumped from the system and the clothing load is spun at a high velocity for water extraction purposes.

In accordance with another aspect of the invention, a sensorless imbalance detection scheme, is implemented, which uses the velocity based load size determination operation described in co-pending U.S. patent application Ser. No. 07/723,277, Electronic Washer Control Including Automatic Load Size Determination, Fabric Blend Determination and Adjustable Washer Means, filed on Jun. 28, 1991, and now U.S. Pat. No. 5,161,393; which application is incorporated herein by reference. The speed response of the basket, and thus the motor, for a constant torque excitation of the motor is linear and independent of imbalances in the low speed ranges. In the higher speed ranges, the speed response becomes a function of any imbalance present in the clothes load, as well as the size of the load. The imbalance is determined by use of the load size information contained in the lower portion of the speed response and the imbalance magnitude information contained in the upper portion of the speed response.

In accordance with another aspect of the invention the terminal spin speed of the machine is reduced in the case of an unbalanced wash load. The spin speed compensation algorithm requires data concerning the mass (weight) of the wet clothes load and the nature of the imbalance. This data may be obtained from discrete sensors or by an algorithm such as the imbalance detection scheme briefly described above. The spin speed compensation algorithm utilizes the data gathered by the imbalance detection scheme to reduce the terminal spin speed based upon the load size and the extent of the imbalance.

In another aspect of the invention, an electronically commutated switched reluctance drive motor is electronically braked to quickly stop the rotating components of the machine. Rather than shorting the motor to stop the rotational action in the shortest time period at the expense of high stress on the mechanical and electronic components of the drive system, a controlled braking scheme is implemented to reduce the stresses yet maintain appropriate braking performance.

BRIEF DESCRIPTION OF THE DRAWINGS

FIG. 1 is a schematic perspective view of a fabric washing machine incorporating one embodiment of the present invention, the view being partly broken away, partly in section and with some components omitted for the sake of simplicity;

FIG. 2 is a block diagram of an electronic control for the machine of FIG. 1 and incorporating one form of the present invention;

FIG. 9 is a simplified flow diagram of the Brake routine incorporated in the flow diagram of FIG. 4;

FIGS. 14*a* and 14*b* are a simplified flow diagram of the Sprinse routine incorporated in the control program of FIG. 12;

DESCRIPTION OF THE PREFERRED EMBODIMENT

Figure 27:
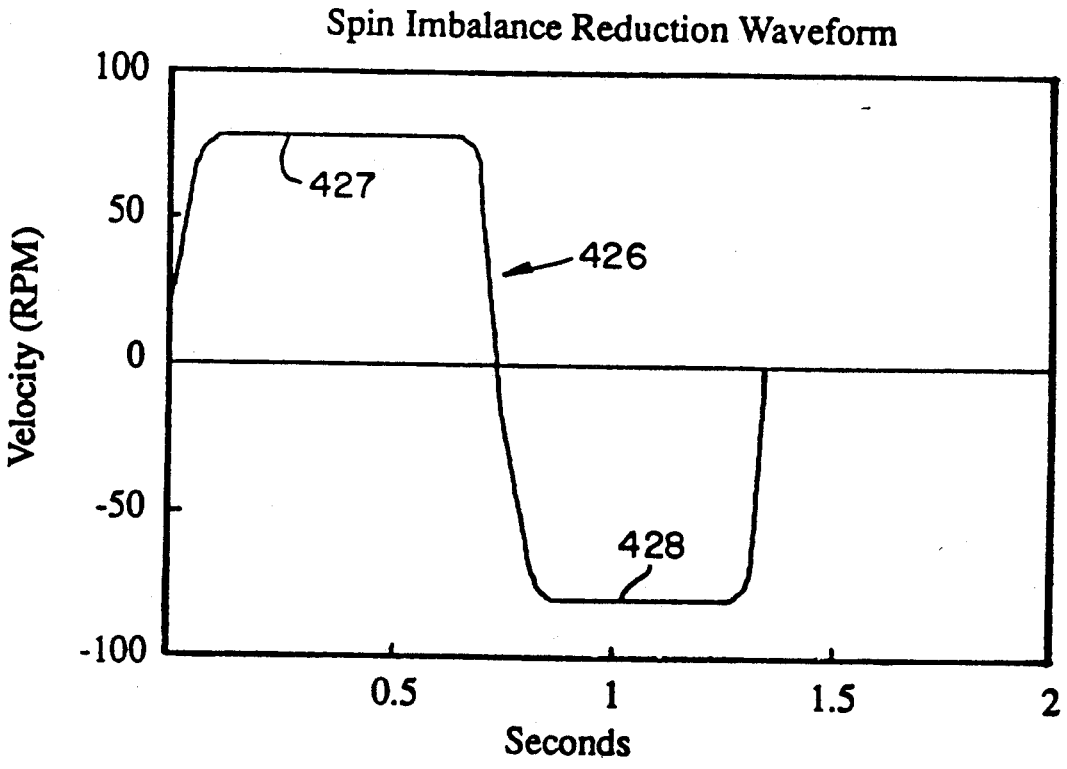
FIG. 27 illustrates an exemplification rotor velocity wave shape for redistribution of a clothes load used in the Spin Imbalance Reduction routine of FIG. 15.

Modern day clothes (fabric) washing machines are intended to wash loads of fabrics in a bath of water and detergent and then extract water from the fabrics by means of a high velocity spinning of the fabric load. In accordance with one embodiment of the present invention, the machine control operates the machine to at least fairly evenly distribute the fabric load throughout the wash container just prior to the spinning operation. This reduces the demands on the various components of the washing machine during the subsequent spin extraction operation. The control operates the machine in a manner such that an asymmetric agitation velocity profile, preferably such as that detailed in FIG. 27 is obtained. In FIG. 27, velocities greater than zero correspond to clockwise rotation of the agitation means, and velocities less than zero correspond to counter-clockwise rotation of the agitation means. FIG. 27 illustrates an agitation action that is purposely asymmetric, in that the rotational distance traveled by the agitation means is greater in the clockwise direction than it is in the counter-clockwise direction. The effect of the clockwise action of the agitation means is to pull the clothes in the clockwise direction. The reduced counter-clockwise action stops the clockwise action of the clothes and moves the clothes back towards, but not to, their original starting position. The net effect of repeated agitation strokes using the velocity profile given in FIG. 27 is to form the clothes into an annulus extending around the basket.

In order to minimize the wrapping of the cloth tightly about the central agitator and yet maintain the redistribution of the load, the asymmetric velocity profile is periodically inverted so that the asymmetric ratio of clockwise rotational distance to counter-clockwise rotational distance is reversed. The velocity profile is cycled a number of times from periods with longer clockwise rotation to periods with longer counter-clockwise rotation back to longer clockwise rotation. This maintains the redistribution and, since the net rotational distance traveled is reduced, the magnitude of the wrapping phenomenon is reduced.

In accordance with another aspect of this invention, a signal representative of the magnitude of the imbalance present in the wash load just prior to high velocity spinning is generated and used to determine the terminal spin speed.

Figure 29:
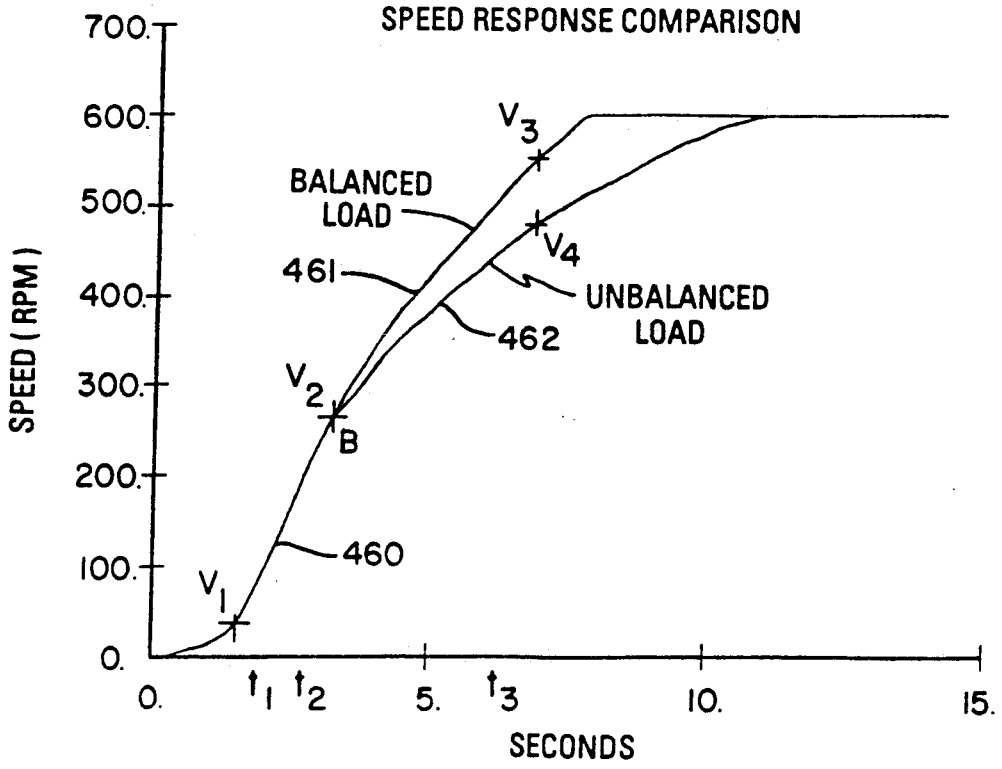
FIG. 29 is a graph depicting the speed response to a constant torque input of a balanced and an unbalanced load.

A typical speed response of a 14 lb. (wet weight) balanced load and the same load with an imbalance of 1.5 lbs. is shown in FIG. 29. In both cases, the motor was excited with a constant torque signal. The total mass of the clothes load was identical in both cases. Both curves follow the same linear path between about 80 and about 250 RPM as a direct result of the total clothes load mass being identical in both cases.

The governing equation for speed response curves is:

$$T = Ia + Kw,$$

where

T = applied torque,
I = moment of inertia,
a = angular acceleration,
K = non-Newtonian frictional coefficient, and
w = angular velocity.

The Newtonian portion of the equation, Ia, is responsible for the overall linear shape of the speed response curve during constant torque excitation. Since the torque and the moment of inertia are constants, the angular acceleration will be a constant if the frictional portion of the equation is zero. As the basket speeds up, the frictional load increases and the angular acceleration decreases as a result. This accounts for the decreasing angular acceleration of a balanced load at high speeds. As the size of the imbalance within a load increases, the angular acceleration decreases at a higher rate, and the clothes load will require a longer period of time to reach full speed.

Co-pending application Ser. No. 07/723,277 describes in some detail the load size information which may be determined using the lower portion of the speed response curve. The upper portion of the speed response curve, that is from about 250 RPM to about 600 RPM, contains information related to the nature of the imbalance. As the imbalance grows in size, the upper portion of the speed response flattens.

The upper portion of the speed response curve contains data pertaining to the magnitude of the imbalance; however, the load size data contained in the lower portion of the curve is needed to differentiate between a larger balanced load and a smaller unbalanced load. If only the upper portion of the curve is used, the time needed to reach a threshold speed value for a larger balanced load may be greater than the time required by a smaller unbalanced load to reach the same speed.

Referring to FIG. 29, when a constant torque signal is applied to the motor with a load of a given size in the rotating basket, the basket and load will accelerate from a first velocity $V_1$ to a second higher velocity $V_2$ along a velocity path, such as 460 for example, that is dependent upon the size of the load but is independent of whether the load is balanced or unbalanced. Beyond the intermediate or threshold velocity $V_2$ the acceleration is dependent on both the load size and the amount or degree of the unbalance. Velocity paths 461 and 462 illustrate a balanced and an unbalanced load of a given size accelerating from $V_2$ to a still higher velocity. In the case of the balanced load, the basket will follow velocity path 461 to reach velocity $V_3$ after a predetermined period of time. An unbalanced load will follow a path similar to 462 to reach a velocity $V_4$, less than $V_3$, after the same predetermined period of time.

To compensate for the mass of the load, the load size data is determined from the lower portion of the curve in the manner as described in co-pending application Ser. No. 07/723,277. The load size data is then used to address a table that contains a series of imbalance time values for various load size values. An imbalance timer is incremented once the basket has exceeded a lower imbalance threshold speed. When the timer has reached the imbalance time value obtained from the table, the speed of the basket is recorded. This speed is inversely proportional to the magnitude of the imbalance and is used to compensate for the imbalance by adjusting the terminal spin speed of the machine.

The suspension system of typical clothes washing machines have identifiable resonant frequencies. There are two unique resonant frequencies within the suspension of the illustrative embodiment. As the mass of the clothes increases, the loading of the suspension is altered, and the resonant frequencies are slightly modified. That is, as the clothes load increases, the resonant frequencies decrease.

If a load of clothes is placed in the basket and spun without any imbalance compensation scheme, the basket and clothes will reach one of a possible three states. The first possible state is a full speed spin; this is the case that is to be expected when the load is sufficiently balanced to pass through both resonant frequencies. The second state is a spin where some portion of the moving system strikes some portion of the stationary support structure. Typically the basket strikes the outer tub. This case occurs when the clothes are unbalanced and the basket cannot pass through the first resonant frequency. As the basket approaches the first resonant frequency, an increasing amount of energy is used in the translational motion of the basket rather than the rotational motion of the basket. Eventually the speed will reach an equilibrium point. If the speed increases, more energy is diverted to the translational motion and the rotational energy is no longer sufficient to overcome the frictional losses of the rotating system. As a result, the basket will slow down to the speed at which the rotational energy is equal to the rotational frictional losses. The third case is similar to the second case except that the second resonant frequency is the speed of interest and the imbalance is small enough to allow the basket to pass through the first resonant frequency but not the second.

At either equilibrium speed, the basket strikes the outer tub, the machine may be walking, and excessive mechanical wear is occurring in the suspension and drive system. In each of these two cases it is desirable to operate the machine at a spin speed lower than the equilibrium speed the basket will reach. By determining the size of the load, which in turn estimates the resonant frequencies, and determining the nature of the imbalance, the terminal spin speed may be adjusted to a point below the equilibrium speed.

In another aspect of the invention, a controlled regenerative brake is implemented. A switched reluctance motor used to rotate the basket is controlled by an electronic motor controller. This controller senses the rotor and stator orientation and energizes phases in the proper sequence and at the proper rate to produce the desired rotational action. For the sake of illustration, a three-phase 6/4 pole machine, shown in FIG. 30, will be described.

Figures 30, 31:
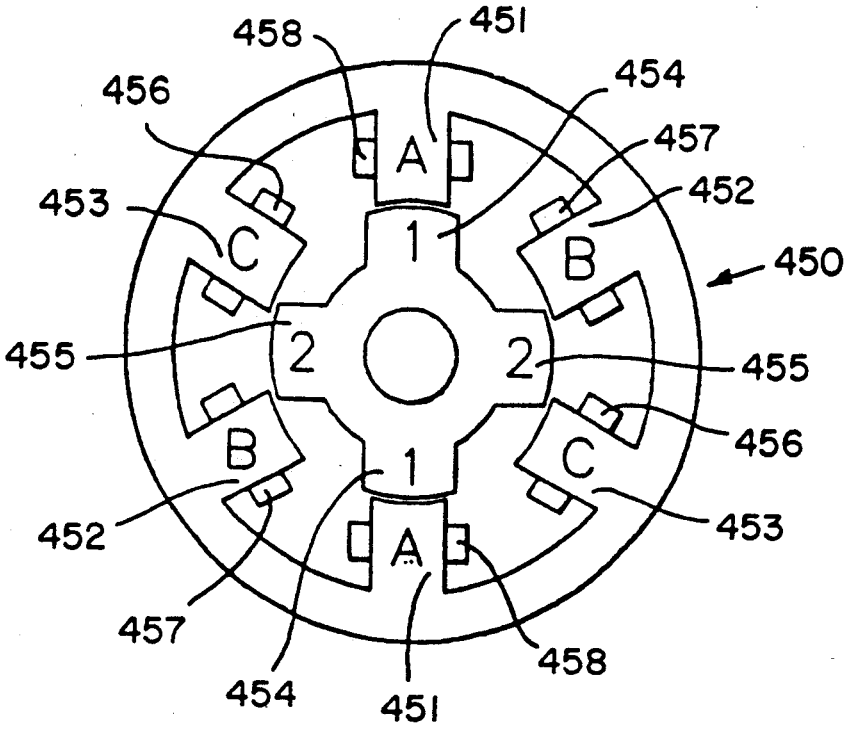
FIG. 30 is a simplified cross sectional view of a switched reluctance motor.
FIG. 31 depicts a decision matrix used to determine the terminal spin speed.

When the machine in FIG. 30 is operated as a motor in the clockwise direction, as rotor phase 1 approaches stator phase A, stator Phase A is energized until stator phase A and rotor phase 1 are aligned, then stator phase C is energized until stator phase C and rotor phase 2 are aligned, then stator phase B is energized until stator phase B and rotor phase 1 are aligned. The stator phases are repeatedly energized in sequence to bring the rotor phases into alignment. This causes the rotor to rotate in a clockwise direction as is well known in the motor art. The phenomena responsible for the alignment of the stator and rotor poles is the magnetomotive force generated by the current carrying coils of the stator poles. The torque produced is a function of several variables; the most important being the magnitude of the current, the stator winding inductances during the varying stages of alignment, the air gap between the stator and rotor poles and the physical dimensions of the motor. The torque will always attempt to bring the stator poles and rotor poles into alignment, thus minimizing the reluctance of the magnetic circuit. By selectively energizing different stator phases at the proper times, the desired rotational velocity will be produced.

If the commutation sequence is altered so that the stator winding is energized after the stator and rotor poles are aligned, the torque will pull against the rotational inertia in an attempt to maintain the stator and rotor pole alignment. As the rotor pole is carried past alignment with the stator pole, a result of rotational energy in the system, the reluctance of the magnetic circuit increases and an electromotive force, or voltage, is generated in an attempt to maintain the current level. This voltage, called back emf, is added to the driving voltage, resulting in a net increase in electromotive force. This increase is proportional to the decrease of the rotational energy in the system. The generation of electromotive force is used to decrease the rotational energy, or brake, the system and is called regenerative braking.

The motor control for the switched reluctance motor used in the preferred embodiment has the capability to produce the commutation cycles needed to produce an electronic brake. The control system implemented within the motor control is illustrated in block form in FIG. 31. As the desired speed decreases, and the basket is traveling at a speed greater than the desired speed, the error signal grows in negative magnitude. A negative error will cause the motor control to produce commutation cycles that result in torque that opposes the rotational inertia until the error signal is reduced to zero or the error signal takes on a positive value.

The illustrative washer control possesses the capability to drive the motor control loop in a torque-based, rather than a speed-based, mode. The electronic brake control monitors the actual rotational velocity of the rotor and outputs a velocity command, of opposite direction, that is comparable to the measured velocity. Rather than tracking the speed exactly, the algorithm outputs a fixed velocity command until the actual velocity drops a set level below the command. At this point, the output velocity is set to the negative of the measured velocity and the process is repeated. When the absolute value of the measured velocity drops below 12 RPM, the estop feature of the motor control is activated. The estop is used to turn on a phase and cease commutations so that the motor will lock. After a set period, the estop is released and the machine placed into the appropriate mode.

Referring now to FIG. 1 there is illustrated a fabric (clothes) laundry machine or automatic washing machine 10 incorporating one form of the present invention. The washer 10 includes a perforated wash container or clothes basket 11 which has an integral center post 12 and agitation ramp 13. The basket 11 is received in a imperforate tub 23. In operation, clothes or other fabrics to be washed are placed in the basket 11 and water is added to the tub 23. As a result of the perforations in the basket 11, the water fills the tub and basket to substantially the same height. In a basic wash operation, detergent is added to the water and the basket is oscillated back and forth about the vertical axis of the center post 12. The ramp 13 causes the fluid and fabrics to move back and forth within the basket to clean the fabrics. At the end of the agitation operation the standing water in the tub 23 is drained. It will be understood that the ramp 13 is illustrative only and any number of other basket configurations can be used to enhance the agitation of the fabrics. For instance, vanes can be formed on the side or bottom walls of the wash container 11, as is well known in the art. It will be understood that the present invention is applicable to machines in which the agitator is separate from the basket.

Additional water is then sprayed on the fabrics until the tub and basket fill to a level sufficient to submerge the fabrics in the water. The basket is oscillated about its vertical axis in an asymmetric manner. This action redistributes the fabrics in the basket in an at least fairly symmetrical or balanced arrangement. It also accomplishes a rinsing of the fabrics. At the end of this "sprinse" operation the water is drained from the tub and then the basket and fabrics are spun at high speed to centrifugally extract water from the fabrics.

The basket or container 11 is oscillated and rotated by means of an electronically commutated motor (ECM) 14 which includes a stator **14*a* and a rotor 14*b*. The rotor 14*b* is directly and drivingly connected to the basket 11 by suitable means such as shaft 15. To this end, one end of the shaft 15 is connected to the rotor 14*b*** and the other end of the shaft is connected to the interior of the center post 12. The basket, tub and motor are supported by a vibration dampening suspension schematically illustrated at 16. The operating components of the washer are contained within a housing generally indicated at 17, which has a top opening selectively closed by a door or lid 18. The housing 17 includes an escutcheon or backsplash 19 which encloses various control components and mounts user input means such as key pads 20 and user output or condition indicating means such as signal lights 21. A portion of the control for the washer may be mounted within the main part of the housing 17 as illustrated by the small box or housing 22 which conveniently can mount drivers and power switch means, such as a transistor bridge, for the ECM 14.

FIG. 2 illustrates, in simplified schematic block diagram form, a washer control incorporating one embodiment of the present invention. An operation control 25 includes a laundry control 26 and a motor control 27. The laundry control 26, as well as its interface with other components such as the user input/outputs 28 and the motor control 27, will be described in more detail hereinafter. A motor control suitable for use with the laundry control 26 is illustrated and described in U.S. Pat. No. 4,959,596 of S. R. McMinn assigned to General Electric Company assignee of the present invention, which patent is incorporated herein by reference. That patent also illustrates and describes in some detail an appropriate ECM which, in this example, is of the switched reluctance motor (SRM) variety.

The operation control 25 stores a number of sets of empirically determined wash values which represent instantaneous angular velocities of the rotor of the ECM and thus of the basket 11. The sets of values are stored as look up tables in the memory of microprocessor 40 (see FIG. 3). The control calls up the values in a predetermined timed sequence and controls the motor in accordance with the then current or latest called up value to provide a wash stroke of the basket 11. One wash stroke of the basket 11 is one complete oscillation. For example, assuming the basket is at a momentary stationary position, one wash stroke includes movement of the basket in a first direction and then return of the basket in the second direction to essentially its original position. A wash cycle or wash operation includes the number of repetitions of the wash stroke to complete the washing or agitation of the fabrics in the detergent solution. A rinse stroke and rinse cycle merely would be forms of a wash stroke and wash cycle in which the basket is oscillated about its vertical axis with a load of fabrics and water but with no detergent in order to remove residual detergent left from a previous wash cycle.

The operation control stores, as another look up table, a set of empirically determined spin values representative of instantaneous rotor speeds, calls up these values in a predetermined timed sequence and controls operation of the motor in accordance with the then currently called up value to provide a spin or centrifugal extraction operation of the basket 11. In a spin operation the basket is accelerated to a designated terminal speed and then operated at that terminal speed for a predetermined period of time in order to centrifugally extract fluid from the fabrics in the basket. The terminal speeds of the rotor for various imbalance sizes are stored in the memory and are less than the terminal speed provided by the spin look up table. The control compares each called up value with the appropriate terminal value and operates the motor in accordance with the value which represents the lower rotor speed. In order to save microprocessor memory space, the look up table is structured so that its terminal speed is appropriate for the balanced load terminal speed.

Any user information for the particular operation the machine is to perform is inputted by user input/output means indicated by box 28 (FIG. 2) and which conveniently may include touch pads or keypads 20 for input and signal lights 21 for output (see FIG. 1) for example. Keypads 20 can be used to select a water level and the water temperature, for example. The signal lights 21 are selectively activated by the control 25 s that the user is able to determine the operational condition of the machine. The output from the motor control 27 goes to drivers 29 and power switch means (such as a power transistor circuit) 30 which, in turn, supplies power to the motor 14. A conventional power supply generally indicated at 36 is connected to the normal 120 volt, 60 hertz domestic electric power. The power supply provides 155 volt rectified DC power to the power switch means through line 31 and 5 volt DC control power to the other components through lines 32, 33, 34 and 35, respectively.

Figure 3:
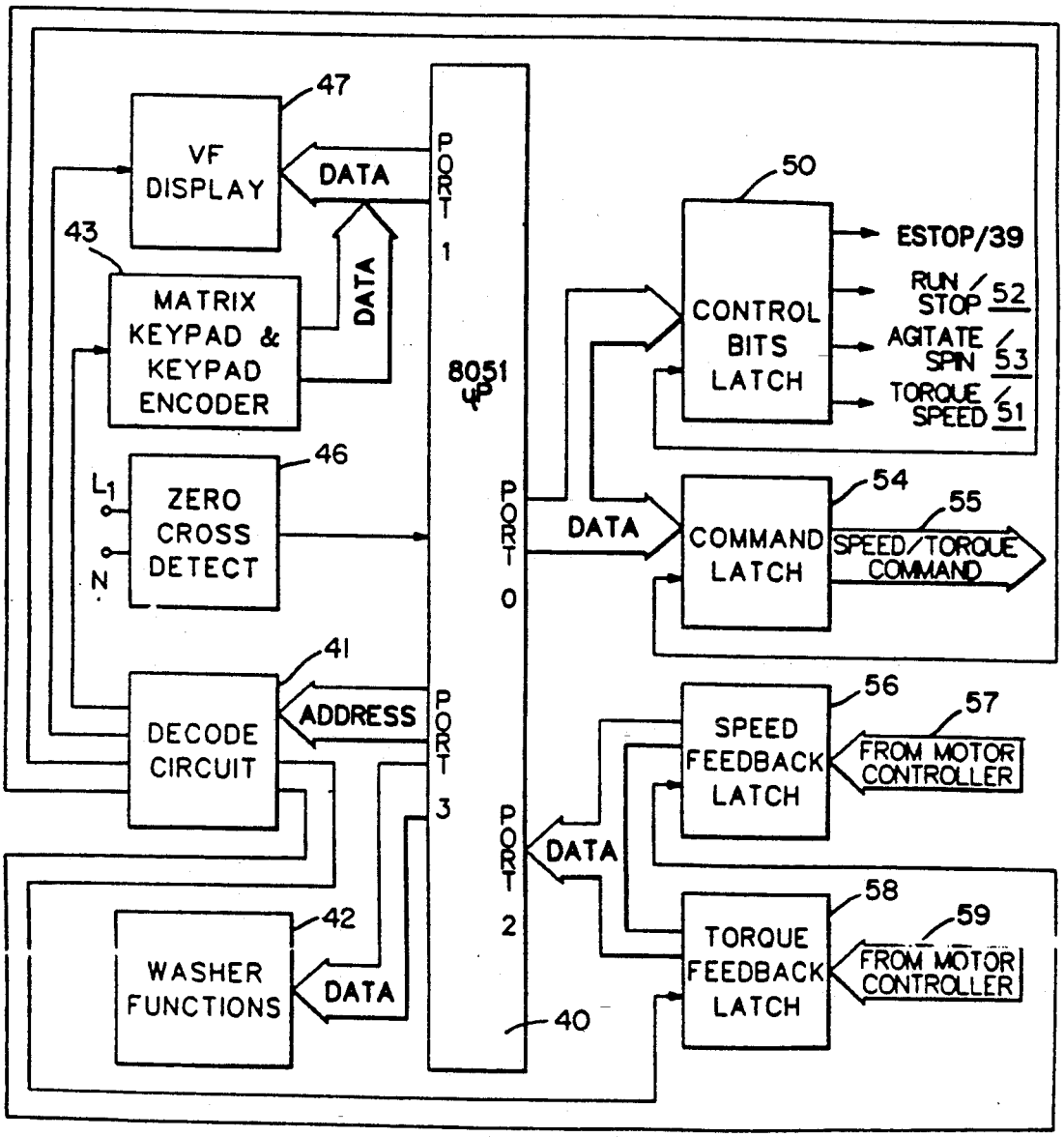
FIG. 3 is a simplified schematic diagram of a control circuit illustratively embodying a laundry control system in accordance with one form of the present invention as incorporated in the control illustrated in FIG. 2.

FIG. 3 schematically illustrates an embodiment of a laundry control circuit 26 for the automatic washing machine of FIG. 1. The circuit in FIG. 3, and the related flow diagrams to be described hereinafter, have been somewhat simplified for ease of understanding. In the system of the present invention, control is provided electronically by microprocessor 40 which, in the illustrative control, is an 8051 microprocessor commercially available from Intel Corporation. The microprocessor 40 has been customized by permanently configuring its read only memory (ROM) to implement the control scheme of the present invention. Microprocessor 40 is connected to a conventional decode logic circuit 41 which is interconnected with other components to provide the appropriate decode logic to such components, as illustrated by the thin lines and arrows. As indicated by the wide arrows labeled DATA, microprocessor 40 interfaces with various other components to transfer data back and forth. Microprocessor 40 controls washer functions such as valve solenoid operation and pump operation via the Washer Functions block 42.

The keypads 20 in the washer backsplash are in the form of a conventional tactile touch-type entry keypad matrix and keypad encoder 43 which, in the illustrative control, are a 4X5 matrix keypad and a 20 key encoder, respectively.

For purposes of illustration, the machine of FIG. 1 and control circuit of FIG. 3 have been illustrated with several user input keypads, as would be the case in a fully featured washer which provides the user the option of inputting data such as load size, blend, water level and temperature. Similarly, in the subsequent description of the program executed by the control, various references to the status of keypads use the term keypad in a general sense.

As will be more fully described hereinafter, sequencing of the microprocessor is timed by sensing the zero crossings of the alternating current input power. To this end, the input of a conventional zero crossing detection circuit 46 is connected to the input power lines ($L_1$ and N) and the output of the circuit 46 is connected to the microprocessor 40. The particular zero cross detection circuit used in the exemplification embodiment provides a signal pulse for each positive going crossing and each negative going crossing of the input power. Thus, the microprocessor receives a timing signal once each half cycle of alternating current, or approximately once each 8.33 milliseconds with a 60 hertz power signal.

The display lights 22 are contained in a VF display 47. The decode logic for display 47 is provided from the decode circuit 41, and data is provided from Port 1 of the 8051 microprocessor 40. Thus, individual ones of lights 21 will be illuminated as called for by the program executed by the microprocessor. A control bits latch 50 is connected to Port 0 of the microprocessor 40 and includes outlet ports connected to four output lines 39, 51, 52 and 53. Thus, in accordance with the program executed by the microprocessor, the control bits latch provides run and stop signals to the motor control 27 through the output line 52, torque and speed signals to the motor control through output line 51, agitation and spin control signals to the motor control through output line 53, and estop signals to the motor control through output line 39. A command latch 54 provides 8-bit digital speed and torque commands to the motor control through output bus 55. Data is written to the command latch via Port 0 of the microprocessor 40, and the decode signal is provided by the decode circuit 41. Feedback latches 56 and 58 are used to hold 8-bit digital speed and torque feedback received via buses 57 and 59 from the motor controller. The outputs from the speed feedback latch 56 and the torque feedback latch 58 are controlled by the decode logic 41 and are connected to Port 2 of the microprocessor 40.

The speed feedback line 57 transmits 8-bit data from the motor control that is representative of the instantaneous angular velocity of rotor and thus the basket. The speed feedback data is calculated inside the motor control circuit 27 by measuring the time interval between stator commutations. This operation is described in the previously mentioned U.S. Pat. No. 4,959,596-McMinn.

The motor control is capable of energizing the motor so that both clockwise and counter-clockwise motions are produced. During the agitation mode, the motor control is capable of energizing the motor to produce up to 150 RPM in each of the clockwise and counter-clockwise directions. During the spin mode, the motor control is capable of energizing the motor to produce up to 600 RPM in both the clockwise and counter-clockwise directions. The feedback from the motor control to the laundry control is comprised of 8 digital bits; the maximum range is from 00 hexadecimal to FF hexadecimal. The highest clockwise rotational velocity for both the agitate and spin modes has been assigned to the hexadecimal value FF. The highest counter-clockwise rotational velocity for both the agitate and spin modes has been assigned to the hexadecimal value 00. The values between hexadecimal 00 and hexadecimal FF have been assigned in a linear fashion to the velocity values between 150 RPM counter-clockwise and 150 RPM clockwise in the agitate mode and to the velocity values between 600 RPM counter-clockwise and 600 RPM clockwise in the spin mode. In both the agitate and spin modes, the 0 RPM case occurs at hexadecimal 80.

The torque feedback bus 59 transmits 8 bit data from the motor control that is representative of the instantaneous motor torque. The torque feedback is calculated within the motor control circuit 27 by measuring the on-time for the modulation circuit controlling the motor current. Since the motor torque is proportional to the current within the motor windings, measuring the on-time of the modulation circuit of motor control 27 provides a signal proportional to torque. As the percentage on-time approaches 100%, the motor output approaches the maximum rated torque. This maximum rated torque is dependent upon which mode, agitate or spin, the motor control is operating, and the maximum allowed current. In the illustrative embodiment, the motor control permits a maximum of 55 Newton meters in agitate and 5 Newton meters in spin.

The motor control is capable of energizing the motor windings in a manner to produce either counter-clockwise (CCW) or clockwise (CW) torque. The torque feedback is comprised of 8 bits with a combined value ranging from 00 (0) to hexadecimal FF (255). The torque values have been assigned in a linear fashion from highest CCW torque represented by 00 through 0 torque represented by 80 and to the highest CW torque represented by hexadecimal FF.

Figure 4:
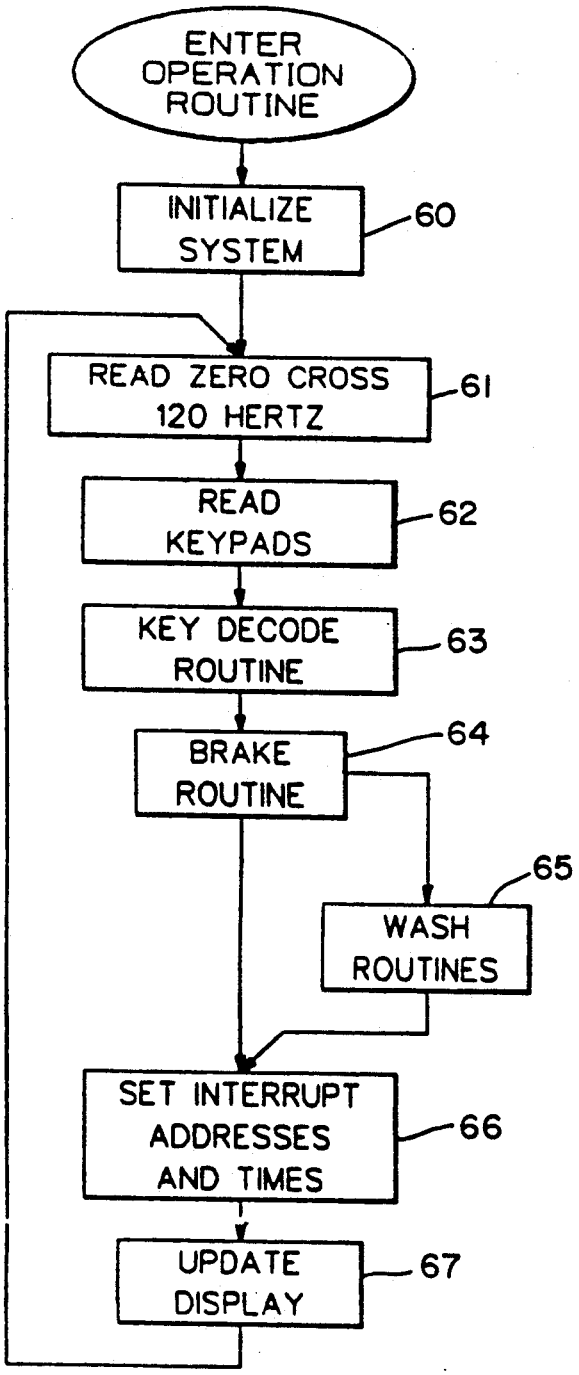
FIG. 4 is a simplified flow diagram of the control program for the microprocessor in the circuit of FIG. 3.

FIGS. 4–22 illustrate various routines performed by the laundry control for a complete washing operation in accordance with one embodiment of the present invention and in which the load is balanced, the spin operations compensate for any residual unbalance and the rotating system is electromagnetically braked in a controlled manner. FIG. 4 illustrates the overall operation of the control system generally as follows. When the control is first turned on, the system is initialized (block 60) as is well known with microprocessor controls. Then the control reads the zero crossing of the 60 hertz power supply (block 61). That is, the control waits until the zero crossing detector 46 indicates that the power supply voltage has again crossed zero voltage. Thereafter, the control reads the keypads (block 62). That is, the internal flag and internal register of the keypad encoder are read. At block 63 the data from the keypad encoder is decoded to determine which keypads have been actuated. The control then enters the Brake routine at block 64. If the Brake routine is not currently active, the control continues to the Wash routines (block 65) and at the end of the wash routines continues to block 66. If the Brake routine is active, the control continues directly to block 66 upon completion of the Brake routine. At block 66 the addresses and the control times for laundry control 26 are set for the Interrupt routine. At block 67 the VF display 47 is updated. Thereafter, the control returns to block 61 and waits for the next zero crossing of the 60 hertz input power signal. When the signal again crosses zero, the operation routine is repeated.

As previously explained laundry control 26 stores a number of sets of empirically determined values representative of particular angular speeds of the rotor **14*b* of the switched reluctance motor (SRM) 14, calls up individual values from a selected set in a predetermined timed sequence and operates the motor in accordance with the then currently called up value to provide a wash stroke to the basket 11**. In the exemplification machine and control there are four sets of values or look up tables; which, for reference purposes, are referred to as a mini load set, a small load set, a medium load set and a large load set. Each set of values is chosen to have 256 individual values for the sake of convenience and ease of operation as 256 ($2^8$) is a number easily manipulated by microprocessors.

Figure 26:
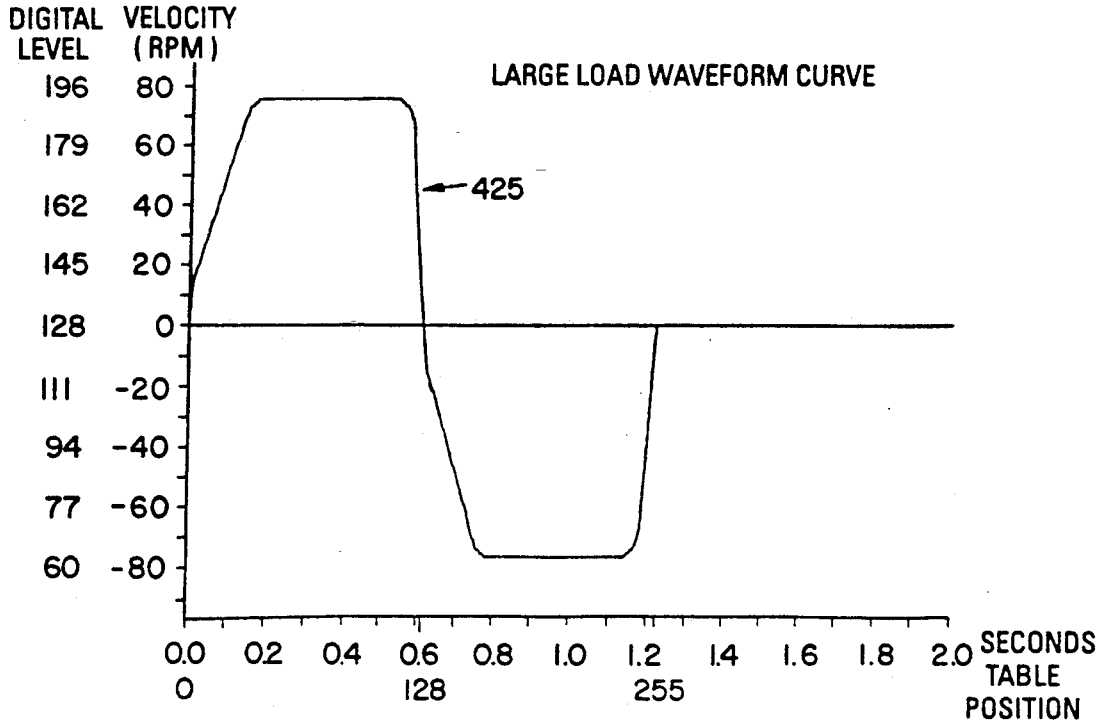
FIG. 26 illustrates an exemplification rotor velocity wave shape for agitation of a large clothes load.

In addition, the microprocessor memory storing the individual sets of values is addressed 256 times for a single stroke, as will be explained in more detail hereafter. As will be noted by reference to FIG. 26, the wash stroke for an exemplification large load waveform takes only approximately 1.2 seconds. Within that 1.2 seconds the memory in the microprocessor is interrogated and a corresponding speed control signal is sent to the motor control by the command latch 256 times. Thus, it will be seen that the motor speed control signals are generated at a very high rate in comparison to the 8.33 millisecond period of the overall operation routine.

Figure 5:
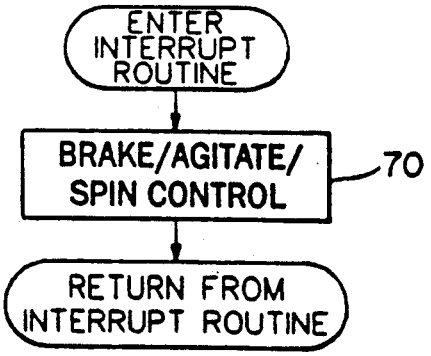
FIG. 5 is a simplified flow diagram of the Interrupt routine incorporated in the control program of FIG. 4.

As illustrated in FIG. 5, when it is time to send a new speed control signal to the motor control, an Interrupt routine interrupts the Operation routine, generates and transmits the motor control signal, as indicated at block 70, and then returns from the Interrupt routine back to the overall Operation routine. The time between successive entries of the Interrupt routine determines the frequency of call ups of numbers or values which define the frequency of the agitation stroke, the acceleration of the spin speed, and the deceleration of the brake algorithm, respectively. If the machine is in the wash (agitate) mode, the control selects the appropriate agitate look up table for the particular load size, calls up the next successive value in that table and transmits that value to the command latch 54. If the machine is in the spin mode, the control selects the spin look up table, calls up the next successive value in that table, compares the called up value to the terminal speed value for that load and blend and transmits the appropriate value to the command latch 54. If the machine is in the brake mode, the control outputs the desired braking speed, which operation will be described in more detail hereinafter.

Figure 6:
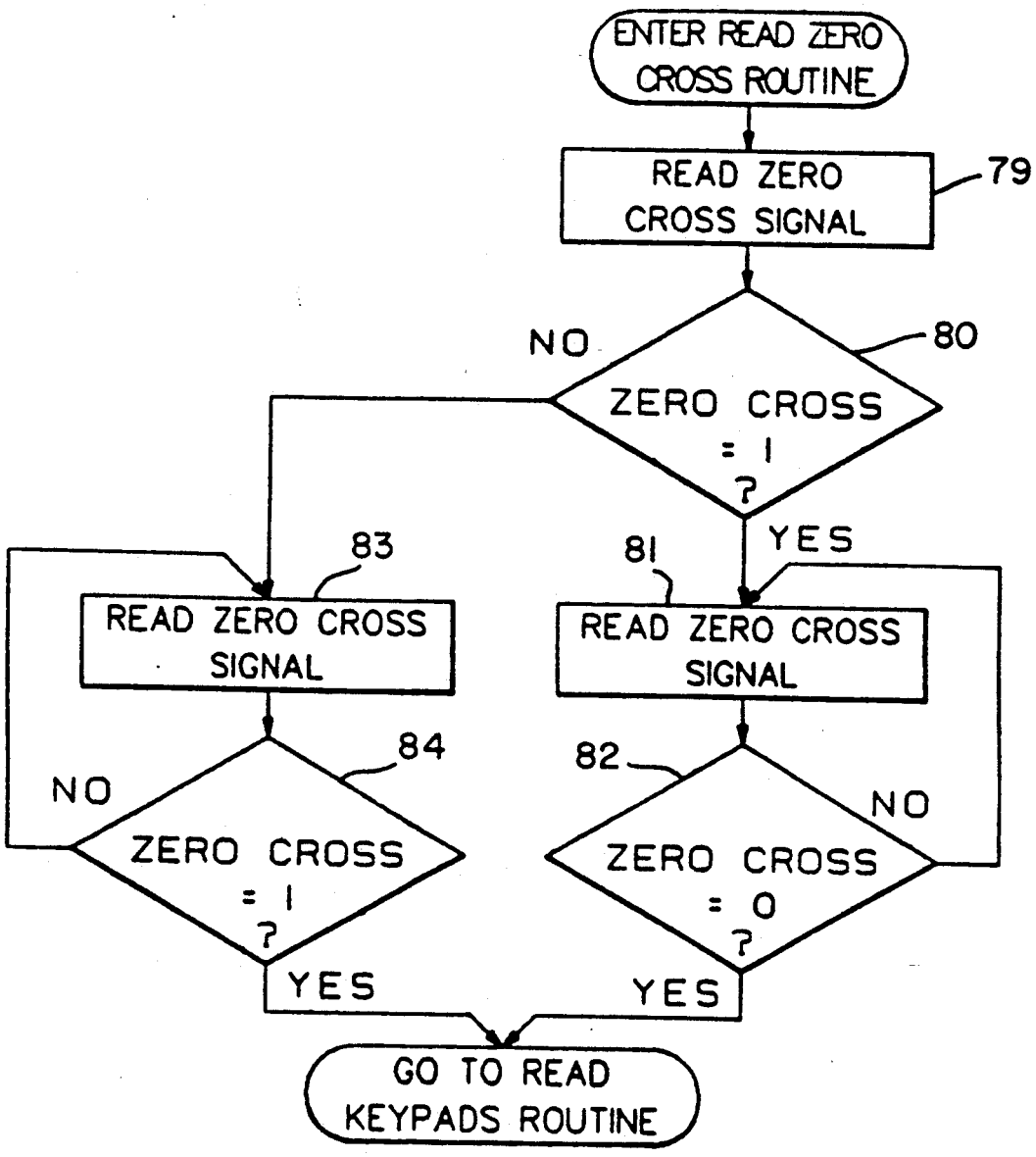
FIG. 6 is a simplified flow diagram of the Read Zero Cross routine incorporated in the control program of FIG. 4.

FIG. 6 illustrates the Read Zero Cross routine of block 61 (FIG. 4) which derives a consistent time base for the program from the periodic power input waveform. If power input voltage is negative, the routine waits for the power input voltage to make the transition from a negative to a positive voltage. If the converse case is true, the routine waits for the power input voltage to make the positive to negative transition. This routine results in the program's main loop executing at a frequency twice that of the power input waveform. When the Read Zero Cross routine is entered, the output of the zero cross detection circuit is read by the microprocessor 40 via Port 3. If the power line signal is in a positive phase of its waveform, the output of zero cross detector 46 (designated ZERO CROSS) is a logic 1. If the power line signal is in a negative phase, ZERO CROSS is a logic 0. After inputting the zero cross signal, the control reads the value of ZERO CROSS (block 79) and determines the logic state of ZERO CROSS (block 80). If ZERO CROSS is logic 1, the zero cross signal is continually read (block 81) until it is determined that ZERO CROSS equals logic 0 (block 82). The change from logic 1 to logic 0 signals that the power supply voltage has crossed zero and the control goes to the Read Keyboard routine. If, at block 80, it is determined that ZERO CROSS is logic 0, the control continuously reads the zero cross signal (block 83) until it determines that ZERO CROSS equals logic 1 (block 84). This also signals a zero crossing or transition of the input power, and the control goes to the Read Keypads, routine. The Read Zero Cross routine thus assures that the Read Keypads routine begins in accordance with a zero crossing or transition of the input power signal on lines L and N, which synchronizes the timing of the entire control.

Figure 7:
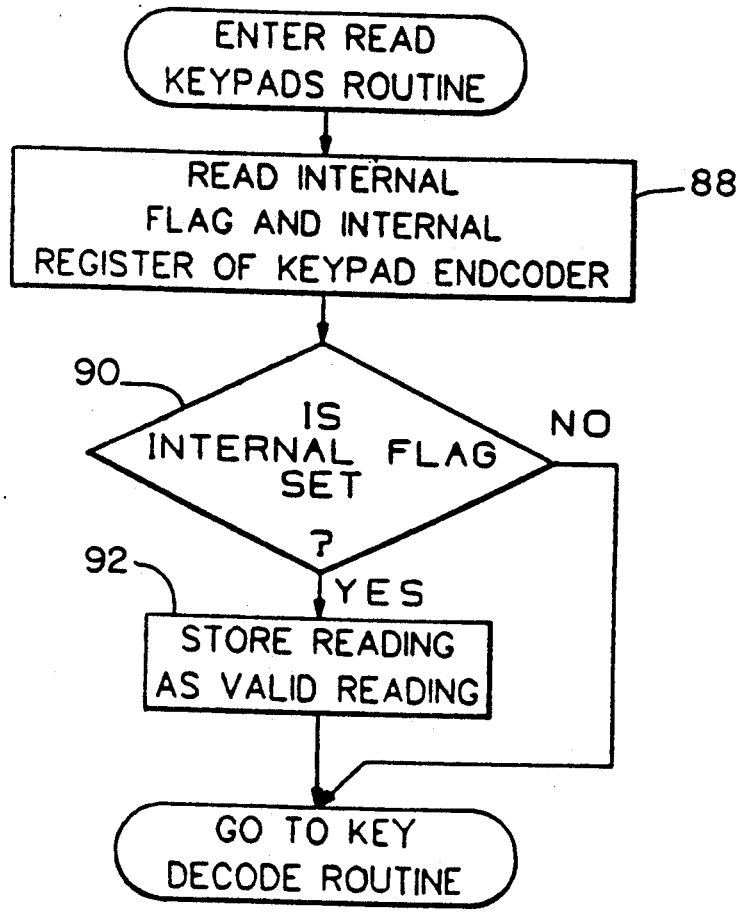
FIG. 7 is a simplified flow diagram of the Read Keypads routine incorporated in the control program of FIG. 4.

In the Read Keypads routine, illustrated in FIG. 7, the control determines the status of the keypads. The key pads are a standard keypad matrix connected to a commercially available keypad encoder chip. The keypad encoder chip toggles the drive lines and monitors the scan lines of the keypads. When the keypad encoder chip determines that a key has been pressed, a flag within the keypad encoder chip is set high. The microprocessor may then test the status of the internal flag of the keypad encoder, and if the flag is set, read the value contained within the key press register of the keypad encoder chip. At block 88 the internal flag and internal register of the keypad encoder is read. At block 90 the control determines if a key is being pressed by the status of the internal flag of the keypad encoder. If this flag is not set, no keypad is pressed and control passes to the Key Decode routine. If the flag is set, the control stores the data obtained from the internal register of the keypad encoder as a Valid Reading (block 92). The control then continues with the Key Decode routine. At the same time the keypads are read, and as part of the same routine, the automatically determined values are retrieved from memory.

Figure 8:
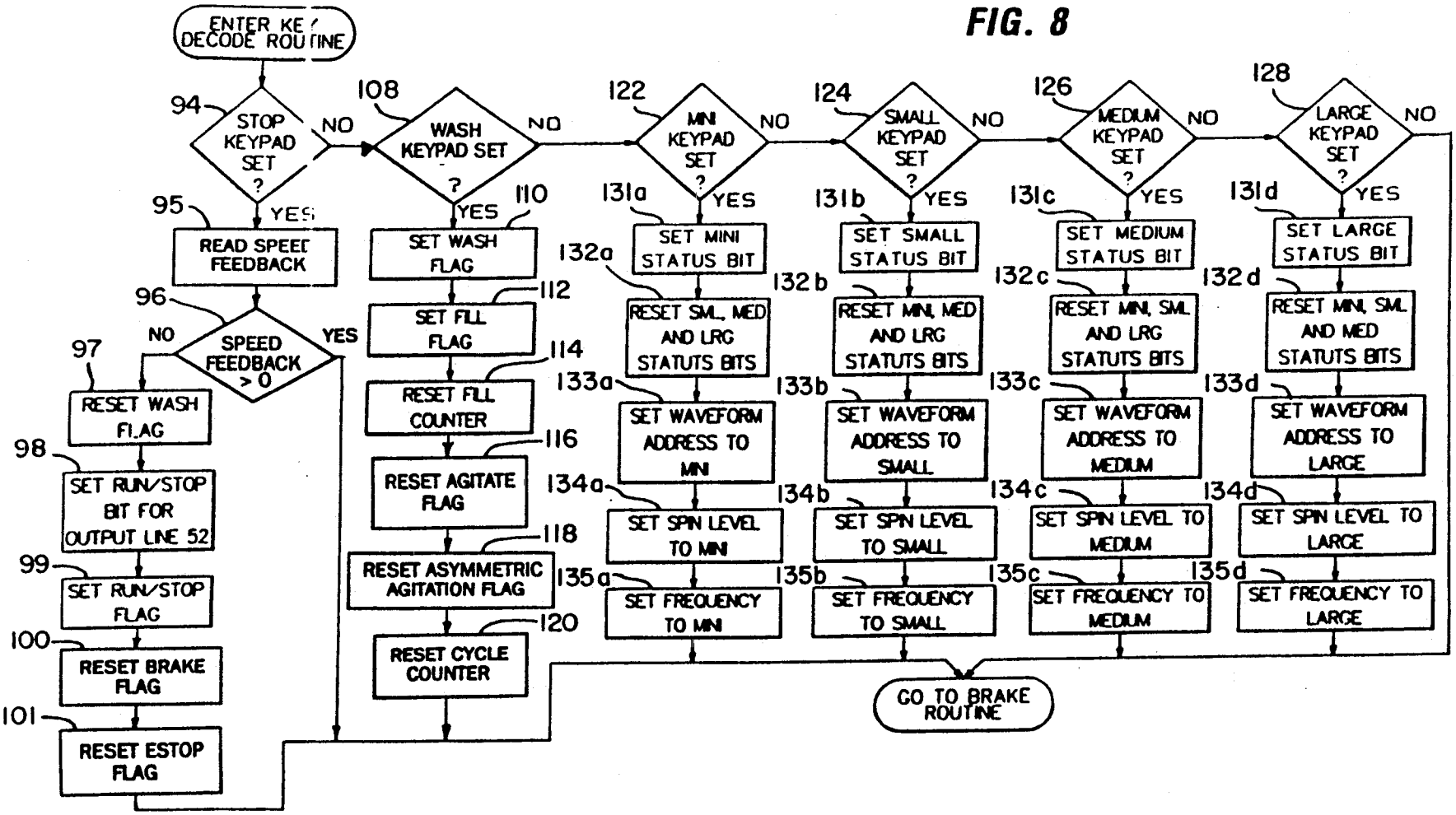
FIG. 8 is a simplified flow diagram of the Key Decode routine incorporated in the control program of FIG. 4.

The Key Decode routine, illustrated in FIG. 8, maps the numeric values received from the keypad encoder within the Read Keypads routine to specific control actions. The keypad encoder returns a value corresponding to the key number of the activated key. The Key Decode routine utilizes this information to set and reset flags and registers to predetermined values that will cause other routines to function in the manner requested by the operator via the keypad interface. The Key Decode routine is entered at inquiry 94 which determines whether the stop keypad is set. The stop keypad may be set in a number of ways. For example, a clock built into the microprocessor or a separate timer will set the stop flag when a cycle of operation has been completed. Also, if desired, one of the keypads 20 may be utilized as a stop keypad to provide the user with a manual means for stopping operation of the machine. With many machines, it is desirable that opening the lid to expose the inside of the basket will cause operation to stop. Thus, a lid switch may be included and set the stop flag when the lid is opened. In any event, when the stop keypad is set the machine is de-energized. Therefore, when the answer to inquiry 94 is yes the speed feedback is read at block 95. The magnitude of the speed feedback is compared to zero at decision block 96 and if it is determined that the speed feedback is greater than zero, the program proceeds with the Brake routine. If the magnitude of the speed feedback is not greater than zero, the negative branch of decision block 96 is taken, the Wash flag is reset at block 97, the run/stop bit for output line 52 is set at block 98, the run/stop flag is set at block 99, the brake flag is reset at 100, and the estop flag is reset at block 101. The program then proceeds to the Brake routine. Setting the run/stop bit at block 98 sends a signal from the laundry control 26 to the motor control 27 which de-energizes the motor 14.

It should be noted at this point that, in the various routines described herein, "set" corresponds to the related component being energized or activated and "reset" corresponds to the component being de-energized or de-activated. One exception is the run/stop bit for output line 52. When this bit is "set" the motor is de-energized and when it is "reset" the motor is energized for convenience in relating the present description to that of U.S. Pat. No. 4,959,596 which uses a protocol in which set means de-energized and reset means energized.

If inquiry 94 determines that the stop keypad is not set, then inquiry 108 determines if the wash keypad is set. If yes, then the wash flag is set at block 110; the fill flag is set at block 112; the fill counter is reset at block 114; the agitate flag is reset at block 116; the asymmetric agitation flag is reset at block 118; the cycle counter is reset at block 120 and the program proceeds to the Brake routine.

If inquiry 108 determines that the wash keypad is not set, then inquiry 122 determines if the mini load keypad is set. If yes, the mini load status bit is set at block 131*a*; the small, medium and large status bits are reset at block 132*a*; the waveform address in the microprocessor read only memory (ROM) is set to the mini load look up table at block 133*a*, the maximum spin level value is set to the mini load size at block 134*a* and the frequency is set to the mini load size at block 135*a*. The program then proceeds to the Brake routine.

The frequency relates to the time period between call ups of successive values in the set of values (look up table) in the microprocessor ROM that are being called up to control the agitation waveform or spin waveform, respectively. In accordance with certain embodiments of the invention, the time period or frequency of call ups may vary depending on the load size.

If inquiry 122 determines that the mini load keypad is not set, then inquiry 124 determines whether the small load size keypad is set. If yes, the small load status bit is set at block 131*b*; the mini, medium and large load status bits are reset at block 132*b*; the waveform address is set to small load at block 133*b*; the spin level is set to the small load size at block 134*b* and the frequency is set to the small load size at block 135*b*. The program then proceeds to Brake routine.

If inquiry 124 determines that the small load keypad is not set, then inquiry 126 determines whether the medium load keypad is set. If yes, the control is set for a medium load of fabrics at blocks 131*c*–135*c* and the program continues to the Brake routine. If inquiry 126 determines that the medium keypad is not set, inquiry 128 determines whether the large keypad is set. If yes, the control is set for a large fabric load at blocks 131*d*–135*d* and the program proceeds to the Brake routine. If inquiry 128 determines that the large keypad is not set, the program proceeds directly to the Brake routine. As previously explained, the four load size keypads are interconnected and mutually exclusive so that one pad must always be set and no more than one pad can be set at any one time. The "NO" path from inquiry 128 is for initial power up purposes, at which time the operator may not yet have activated any of the load keypads.

The Brake routine, block 64 of FIG. 4, is detailed in FIG. 9. The Brake routine utilizes the regenerative braking capabilities of the motor in a controlled manner to stop all rotational action of the moving system, that is the motor rotor, agitator and clothes basket, within a predetermined time period. The braking torque of the motor is implemented as a function of the mode in which the motor is operating, agitate or spin, and the value of motor speed. When the Brake routine has slowed the system to a speed at which the stresses, both mechanical and electrical, of energizing a single motor phase are no longer potentially damaging to the machine, a final stop (estop) is implemented which energizes a single phase of the motor and locks the rotor against further rotation. The status of the lid switch is checked at decision block 140. If the lid is not open, the program branches to decision block 141 where the status of the end of spin flag is determined. If the end of spin flag is not set, the status of the stop keypad is checked at decision block 142. If the stop keypad is pressed at decision block 142, or if the end-of-spin flag is set at decision block 141, or if the lid is open at decision block 140, a braking action is required, and the program branches to decision block 143 where the status of the brake flag is checked. If the brake flag has not been set, indicating that this is the first pass through the brake algorithm, the control reads the speed feedback signal from latch 56 (FIG. 3) at block 144. The magnitude of the speed feedback signal is then compared to a value representative of 0 RPM at decision block 145. If it is determined that the speed is equal to 0 RPM, indicating the machine is not rotating, the program branches to block 146 where the brake flag is reset; the estop flag and bit are reset at blocks 147 and 148, and the program continues to the Fill routine.

If decision block 145 determines that the basket is turning (the magnitude of the speed feedback signal is greater than the zero RPM value), the control sets the brake flag at block 149. Decision block 150 is then used to determine if the machine is in agitate or spin mode. If the machine is in agitate mode, the program branches to block 151 where the brake increment is set to 20 RPM. If the machine is in spin mode, the program branches to block 152 where the brake increment is set to 100 RPM. The brake increment is the increment by which the brake algorithm reduces the command speed in agitate and speed modes. The increment of 20 and 100 RPM were empirically chosen to cause the machine to quickly stop without overtaxing the system. They take into account that agitation is a relatively low speed/-high torque operation, while spin is a relatively high speed/low torque operation. Since this is the first pass through the brake routine, the initial brake speed, the value from which the brake increment is decremented, is set at the speed feedback signal value at block 153. The program then proceeds to decision block 154 where the magnitude of the speed feedback signal is checked against a value representative of 12 RPM. If it is determined that the speed is not less than 12 RPM, the magnitude of the speed feedback signal is compared to the value obtained by subtracting the brake increment value (block 151 or 152) from the magnitude of the brake speed value (block 153) at decision block 155. If the magnitude of the speed feedback signal is smaller, the brake speed value is set equal to the current speed feedback signal at block 156, and the program then proceeds to the Update Display routine. If the magnitude of the speed feedback signal is not equal to or greater than that value obtained at decision block 155, the negative branch is taken from decision block 155 and the program proceeds directly to the Update Display routine.

If decision block 154 determines that the magnitude of the speed feedback signal is less than the value representative of 12 RMP, the control sets the estop flag and the estop bit at blocks 157 and 158, respectively. The program then proceeds to the Update Display routine. If the brake flag is set at decision block 143 , indicating that the control has completed at least one pass through the Brake routine, the speed feedback is read at block 159. The program then proceeds with blocks 154–158 as described previously.

It will be recognized that the Brake routine just described determines whether the machine is in agitation or spin and sets the brake increment at either 20 RPM for agitation or 100 RPM for spin and sets the brake speed at the existing motor speed. The Brake routine then repeatedly subtracts the brake increment from the brake speed and compares that value to the motor feedback. Each time the motor speed falls below the brake speed by the amount of the brake increment, the brake speed is reset to the just measured motor speed. As will be explained in more detail in connection with FIG. 20, the motor is braked by energizing its stator phases in the same sequence, but after the energized stator phase and a corresponding rotor have become aligned (regenerative braking). Once the motor speed is reduced to less than 12 RPM, the Brake routine sets the estop flag and bit for final stopping of the motor by continuously energizing one stator phase.

The regenerative braking scheme may be described in terms of the illustrative motor 450 detailed in FIG. 30. The motor 450 is a 3 phase switched reluctance motor with stator pole pairs A (451), B (452) and C (453), rotor pole pairs 1 (454) and 2 (455), and stator phase windings A (458), B (457), and C (456) wrapped around the stator pole pairs A (451), B (452) and C (453) respectively. To produce clockwise rotation of the illustrated rotor, stator phase C (456) is energized until rotor pole pair 2 (455) is aligned with stator pole pair C (453). Phase B (457) is then energized until rotor pole pair 1 (454) is aligned with stator pole pair B (452). Phase A (458) is then energized until rotor pole pair 2 (455) is aligned with stator pole pair A (452). The sequence is then repeated first aligning rotor pole pair 1 (454) with stator pole pair C (453), second aligning rotor pole pair 2 (454) with stator pole pair B (452), and third aligning rotor pole pair 1 (454) with stator pole pair A (451). The sequential energization of phases C, B, and A continues to produce the desired clockwise rotation.

When a regenerative braking mode is required while the motor is rotating clockwise, the sequencing of the phases required for clockwise rotation is preserved. That is phase C is energized, followed by energizing phase B, followed by energizing phase A, and then repeating the sequence. However, unlike the motor mode, the phases are energized after alignment rather than prior to alignment. Dealing with braking during clockwise rotation and beginning with the state illustrated in FIG. 30, phase A (458) to stator pole pair 451. This force resists the clockwise rotation and will reduce the clockwise velocity. If phase A remains energized after rotor pole pair 2 (455) becomes aligned with stator pole pair C (453), phase A will begin attracting rotor pole pair 2 (455) with a greater force than that attracting rotor pole pair 1 (454). The net result would be production of motoring torque that will accelerate the motor in the clockwise direction. Therefore when rotor pole pair 2 (455) becomes aligned with stator pole pair C (453), phase A (458) is deenergized and phase C (456) is then energized to produce a braking force. Upon alignment of rotor pole pair 1 (454) and stator pole pair B (452), phase C (456) is deenergized and phase B (457) is then energized to produce the brake torque. The process is then repeated energizing phase A (458) upon alignment of rotor pole pair 2 (455) and stator pole pair A (451), then energizing phase C (456) upon alignment of rotor pole pair 1 (454) and stator pole pair C (453), and then energizing phase B (457) upon alignment of rotor pole pair 2 (454) and stator pole pair B (452). During this regenerative braking phase of the system, the motor is being operated as a generator and mechanical energy is being converted into electrical energy.

Figure 10:
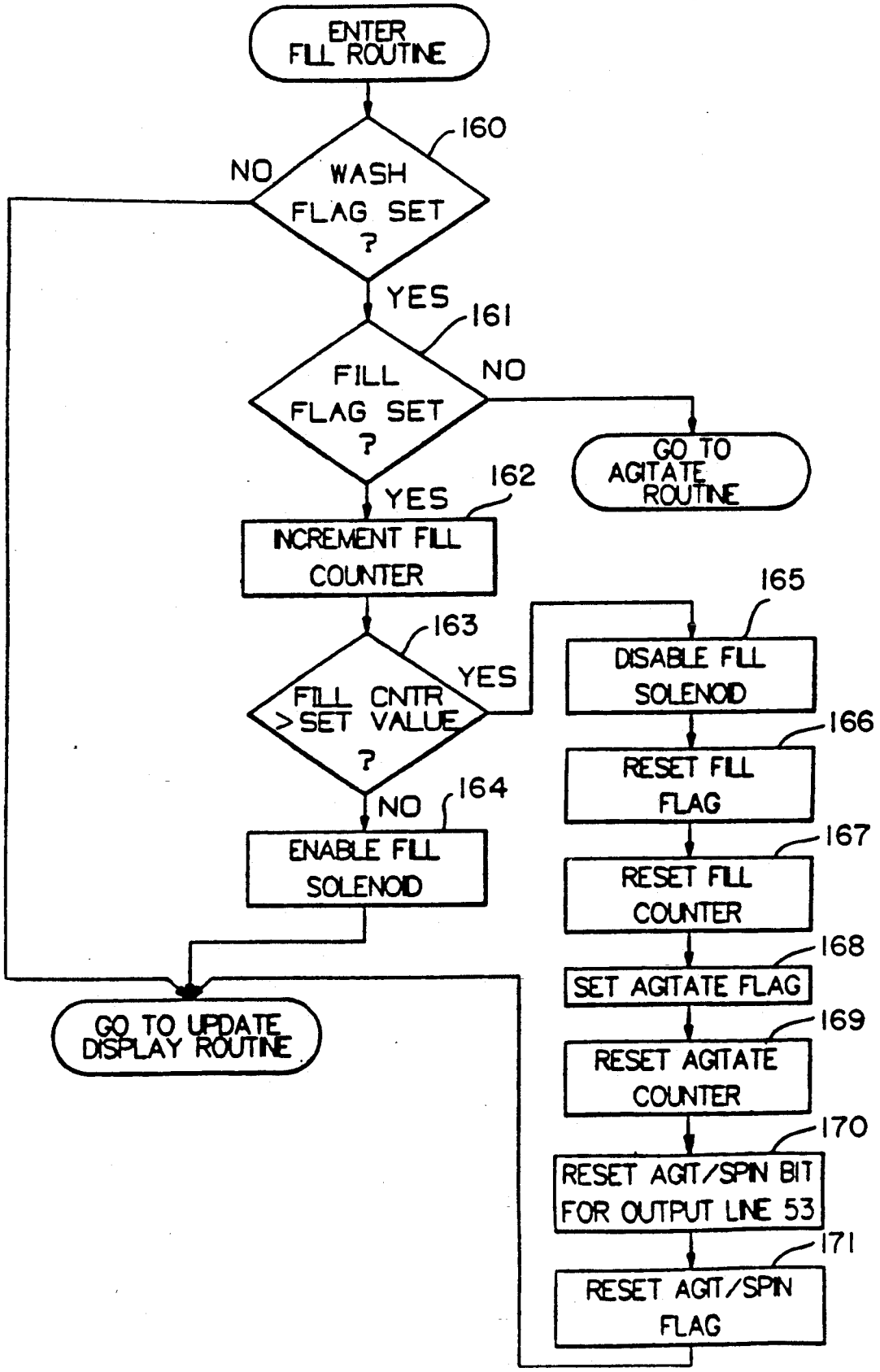
FIG. 10 is a simplified flow diagram of the Fill Routine incorporated in the flow diagram of FIG. 4.

The Fill routine controls the addition of water to the machine and is illustrated in FIG. 10. It is entered at inquiry 160, which determines whether the wash flag is set to indicate a wash operation is called for. If the wash flag is not set, the program proceeds to the Update Display routine. If the wash flag is set at inquiry 160, the control recognizes that a wash operation is called for. Then inquiry 161 determines whether the fill flag is set. If the fill flag is set, the program then proceeds to block 162, where the fill counter is incremented one step. Then inquiry 163 determines if the fill counter is greater than the set value. It will be understood that, with the illustrative machine, the flow rate of water is constant so that the proper amount of water for the selected load will enter the machine in a predetermined time period. When inquiry 163 determines that the fill counter is less than the set value, more water is needed and the fill solenoid is enabled at block 164. The program then proceeds to the Update Display routine.

When inquiry 163 determines that the fill counter is greater than the set value, the processor knows that the fill function has been completed and sufficient water is in the machine. Therefore, the fill solenoid is disabled at block 165; the fill flag is reset at block 166; the fill counter is reset at block 167; the agitate flag is set at block 168, and the agitate counter is reset at block 169 The agit/spin bit for output line 53 is reset at block 170; the agit/spin flag is reset at block 171 and the control program proceeds to the Update Display routine. (For ease of interfacing the present description with that of U.S. Pat. No. 4,959,596—S.R. McMinn, the protocol for agit/spin bit 53 is "set" equals spin and "reset" equals agit.). Returning to inquiry 161 when the fill flag is not set, the control recognizes that the fill operation is complete. Then the program goes to the Agitate and Spin routines For each fill operation, the Fill routine is executed numerous times until the fill counter reaches the predetermined set value (inquiry 163). At that time, block 166 resets the fill flag. In the next pass into the fill routine, inquiry 161 will determine the fill flag is not set (it is reset) and jump to the Agitate and Spin routines.

Figure 11:
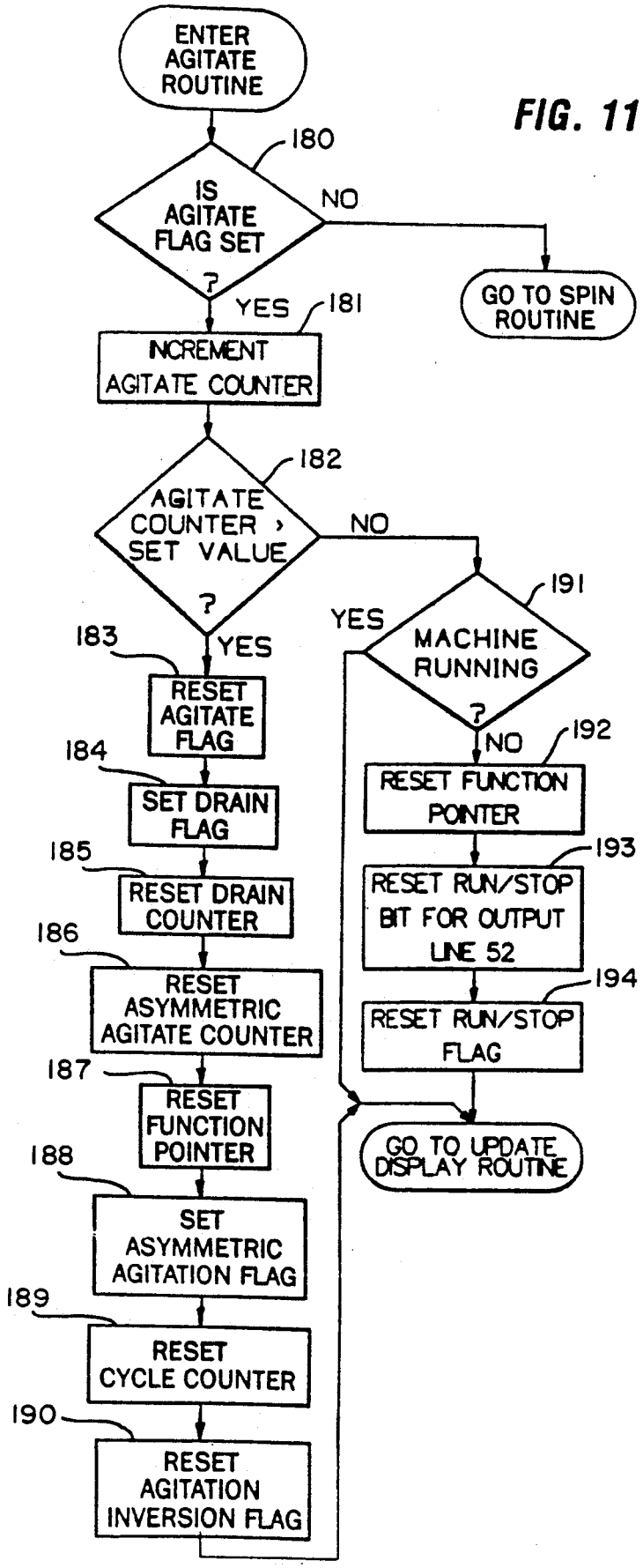
FIG. 11 is a simplified flow diagram of the Agitate routine incorporated in the control program of FIG. 4.

FIG. 11 illustrates operation of the control to implement the Agitate routine, which times the agitation portions of the wash cycle. In this regard it energizes the motor at the beginning of the agitation cycle, and sets and resets the flags and registers to a state that will allow the machine to execute the next portion of the cycle upon completion of the agitation portion. The actual agitation waveform is outputted via an interrupt routine that has a variable time base so that variable agitation periods may be produced. Inquiry 180 determines whether the agitate flag is set. If yes, the agitate counter is incremented at block 181 and inquiry 182 determines whether the agitate counter is greater than the set value. It will be understood that the agitation (wash or rinse) operation will go on for an extended period of time with the basket 11 oscillating to impart washing energy to the fabrics and the water/detergent solution in which they are immersed. In a simple machine, this period may always be the same value, such as 15 minutes, for example. In a more fully featured machine, the time may vary, depending on the load size, in which case the set value of the agitate counter will be determined for the particular load at the appropriate one of the Mini, Small, Medium and Large status bits (see FIG. 8). When inquiry 182 determines that the agitate counter is greater than the set value, agitation is complete and the program proceeds to reset the agitate flag at block 183; set the drain flag at block 184; reset the drain counter at block 185; reset the asymmetric agitate counter at block 186; reset the function pointer at block 187; set the asymmetric agitation flag at block 188; reset the cycle counter at block 189 and reset the agitation inversion flag at block 190. This programs the machine for the pending drain operation and the program then proceeds to the Update Display routine.

When inquiry 182 determines that the agitate counter is not greater than the set value, the program proceeds to inquiry 191 where it is determined if the machine is running. If the machine is running, the program proceeds to the Update Display routine. If the machine is not running, the function pointer is reset at block 192; the run/stop bit for output line 52 is reset at block 193 and the run/stop flag is reset at block 194, the program then proceeds to the Update Display routine. Returning to inquiry 180 upon completion of the Agitate routine, the agitate flag will be reset at block 183, and subsequent executions of inquiry 180 will result in the program proceeding directly to the spin routines.

Figure 12:
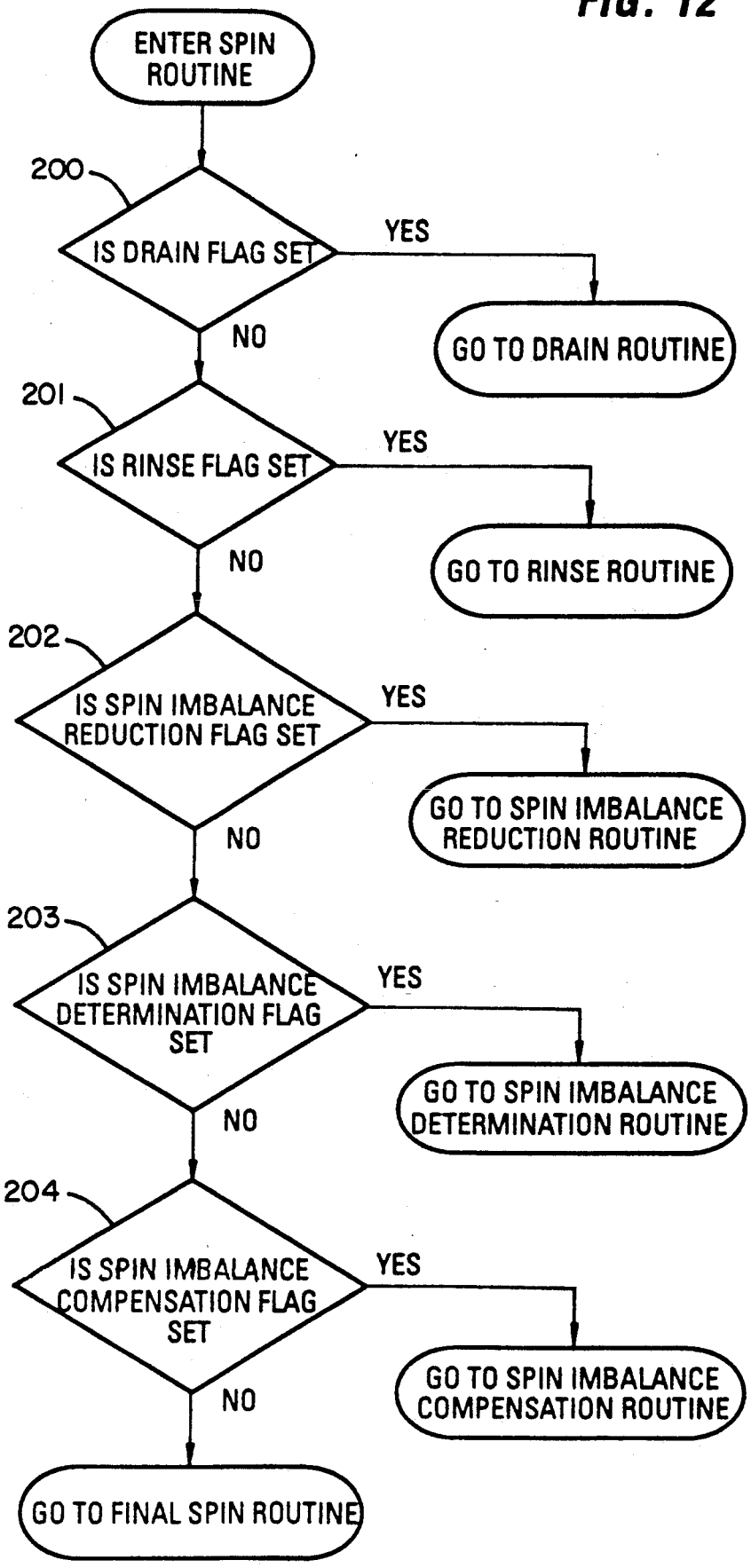
FIG. 12 is a simplified flow diagram of the Spin routine incorporated in the control program of FIG. 4.

FIG. 12 describes the spin routine that is used to control spin operations of the machine. The spin operation of the machine is composed of a number of processes that accomplish the draining of the wash water, a spray rinse, or sprinse, a redistribution action designed to balance the clothes, a measurement process to qualify the nature of any remaining imbalances, and selection of the final spin speed to compensate for any remaining imbalances. Flags are set or reset in accordance with the desired operation. FIG. 12 illustrates the manner of checking of the status of the Drain flag, Sprinse flag, Spin Imbalance Reduction flag, Spin Imbalance Determination flag, and Spin Imbalance Compensation flag, and the branching to the appropriate routines. The Spin routine is entered at decision block 200 which checks the status of the drain routine. If the drain flag is set, indicating that the machine should be executing a drain operation, the program proceeds to the drain routine illustrated in FIG. 13. If the drain flag is not set, the status of the sprinse flag is checked at inquiry 201. If the sprinse flag is set, indicating that the machine should currently be executing the sprinse routine, the program proceeds to the sprinse routine. If the sprinse flag is not set, the status of the spin imbalance reduction flag is checked at inquiry 202. The affirmative branch of inquiry 202 leads to a jump to the spin imbalance reduction routine. The negative branch leads to inquiry 203 where the status of the spin imbalance determination flag is checked. When the spin imbalance determination flag is set, the program proceeds to the spin imbalance determination routine; otherwise, the program continues with inquiry 204 where the status of the spin imbalance compensation flag is checked. If the spin imbalance compensation flag is set, the program proceeds to the spin imbalance compensation routine. If the spin imbalance compensation flag is not set, the program proceeds to the final spin routine.

Figure 13:
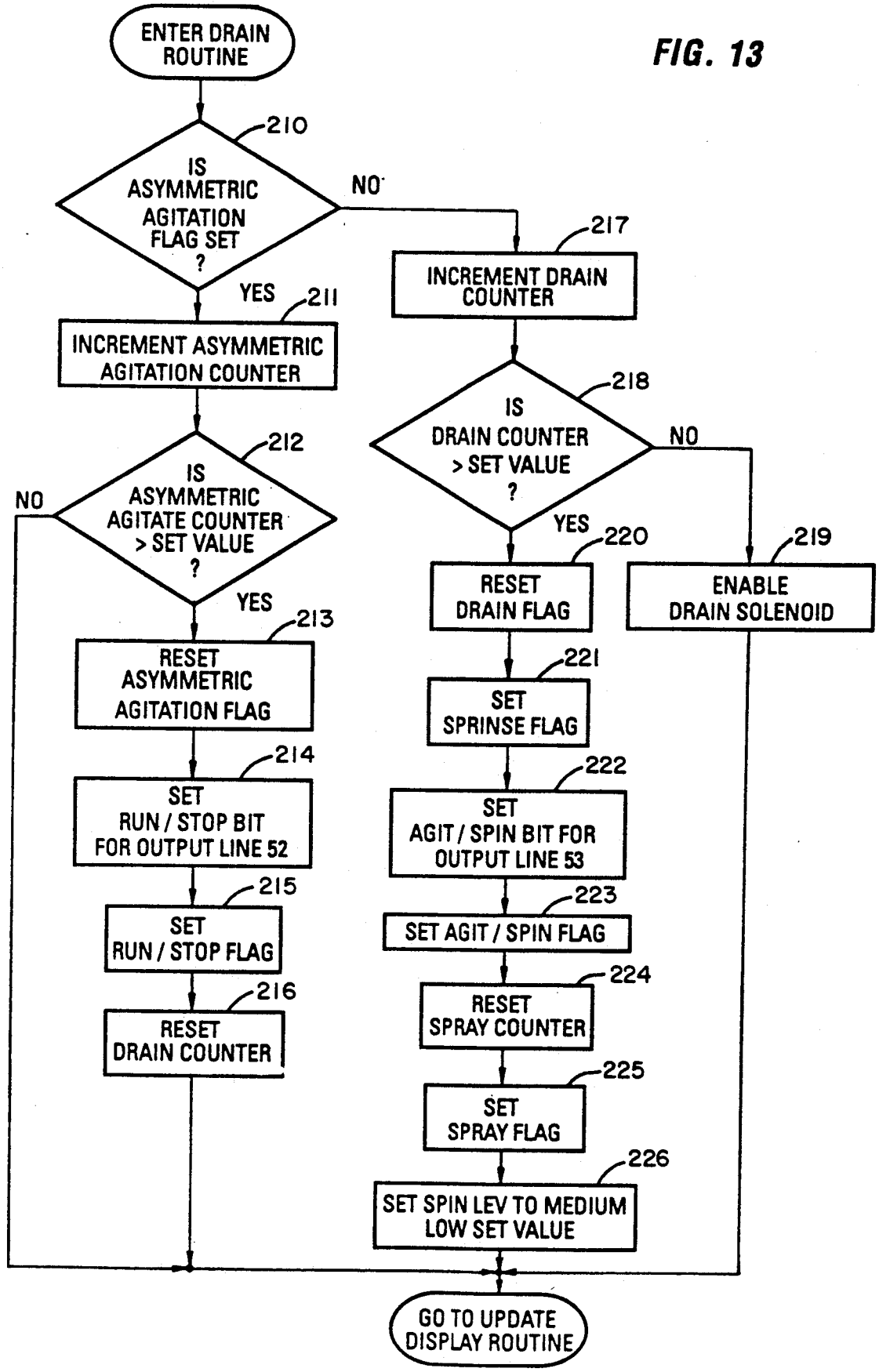
FIG. 13 is a simplified flow diagram of the Drain routine incorporated in the control program of FIG. 12.

The drain routine is illustrated in FIG. 13. As previously discussed, the machine is set into the required mode to execute the asymmetric agitation portion of the drain routine upon completion of the wash agitation routine. The status of the asymmetric agitation flag is checked at inquiry 210; if the flag is set, indicating a pending asymmetric agitation action, the program branches to block 211, where the asymmetric agitation counter, used to program the duration of the asymmetric agitation cycle, is incremented. The counter is compared to a set value at inquiry 212. If the desired time period of asymmetric agitation has not elapsed, the program proceeds to the Update Display routine. If the asymmetric agitation period is complete, the program branches from inquiry 212 to block 213, where the asymmetric agitation flag is reset. The run/stop bit for output line 52 and the run/stop flag are set at blocks 214 and 215 respectively in order to de-energize the drive system of the washer. The drain counter is reset at block 216 in preparation for the pending drain action. The program then proceeds to the Update Display routine.

If, at inquiry 210 the asymmetric agitation flag is not set (i.e., is reset), this indicates the asymmetric agitation portion of the drain routine is complete and the washer will now drain the water from the wash container as the drain flag was set at block 184 in FIG. 11. The drain counter, used to program the duration of the drain action, is incremented at block 217. The value of the drain counter is compared against a set time value at inquiry 218. If the drain counter is smaller than the set value, the drain operation is not complete and the program branches to block 219 where the drain solenoid is enabled. The program then jumps to the Update Display routine. If the drain counter is greater than the set value at inquiry 218, the drain action should stop and the machine should be prepared for the spray rinse (sprinse). This process begins with block 220 where the drain flag is reset. The sprinse flag is set at block 221 to indicate the impending sprinse routine. The agit/spin bit for output line 53 is set at block 222 and the agit/spin flag is set at 223. This causes the machine to operate in a spin mode rather than an agitation mode. The spray counter, used to program the duration of the spray portion of the sprinse routine, is reset at block 224. The spray flag, used to initiate the impending spray action of the sprinse routine, is set at block 225, the spin level is set to a medium low set value at block 226, and the program then jumps to the Update Display routine.

Figure 14A:
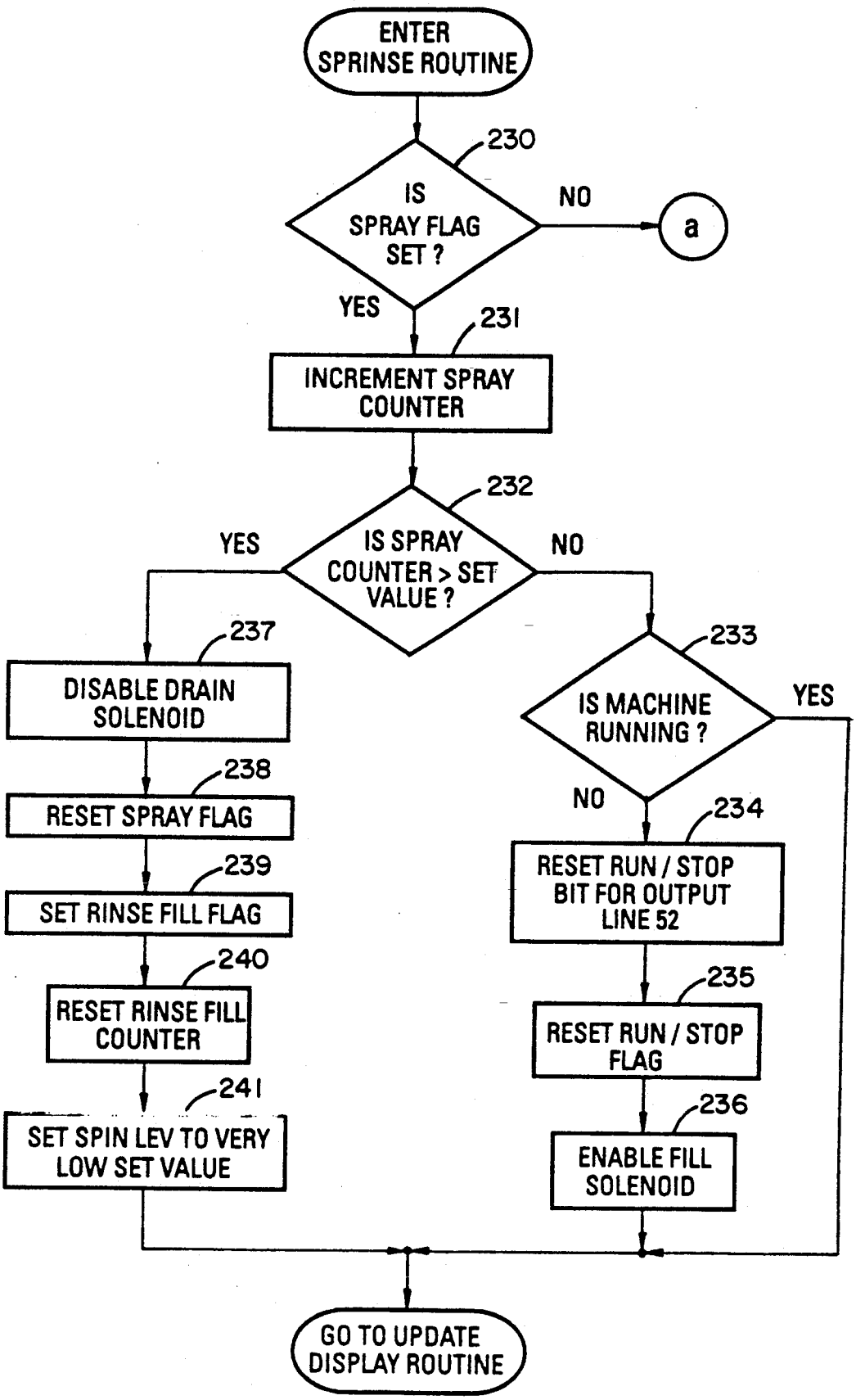

The Sprinse routine, shown in FIGS. 14*a* and 14*b*, provides the transition from draining to rinse fill. Upon completion of draining the wash water, the Sprinse routine causes a slow speed spin to be executed and opens the water valves for the spray addition of rinse water with the draining action continuing during this action. This spin and spray action (Sprinse) is designed to lessen the residual sudsing from the wash cycle, and persists for a predetermined length of time. Upon completion of the Sprinse action, the draining action is halted and the water valves remain open for filling the wash container with rinse water. Once the rinse water is added, the machine is stopped, the water valves are de-energized, the fabric softener indicator may be illuminated for a predetermined period of time, and then the machine is set into a mode for the spin imbalance reduction routine. The status of the spray flag is checked at inquiry 230, FIG. 14*a*. If the spray flag is set, the program branches to block 231 where the spray counter is incremented. The value of the spray counter is compared against the set time value for the spray action at inquiry 232. If the spray counter is less than the set value, the program branches to inquiry 233 where it is determined if the machine is running. If inquiry 233 determines that the machine is running, the program jumps to the Update Display routine; otherwise, the program energizes the drive mechanism and spray by resetting the run/stop bit at block 234, resetting the run/stop flag at block 235 and enabling the fill solenoid at block 236. The program then jumps to the Update Display routine. If inquiry 232 determines that the spray counter is greater than the set time value for the spray action, the program branches to block 237 where the drain solenoid is disabled. The spray flag is reset at block 238; the rinse fill flag is set at block 239; the rinse fill counter is reset at block 240; and the spin level is set to a very low set value at block 241 in preparation for the fill portion of the sprinse routine. The program then jumps to the Update Display routine.

It will be understood that water spray/fill mechanisms are well known and have been omitted for the sake of simplicity. Typically water is added to the container by spraying it into the basket so that is impinges on the fabrics. Thus in the typical washer the sprinse spray and subsequent fill actions use the same fill mechanism. They are merely timed separately.

If inquiry 230 determines that the spray flag is not set (i.e., is reset), the program branches to the portion of the sprinse routine shown in FIG. 14*b*, which is the rinse fill and fabric softener addition procedures of the Sprinse routine. The status of the rinse fill flag is checked at inquiry 241. If a rinse fill is called for, the program branches to block 242. The machine is currently executing a low speed spin action that was initiated during the spray procedure. The rinse fill counter is incremented at block 242 and the counter is compared against a set time value at inquiry 243. If the counter is not greater than the set time, the program jumps to the Update Display routine. If the rinse fill counter is greater than the set time value, the program branches to block 244 where the fill solenoid is disabled. The rinse fill flag is reset at block 245 to indicate the completion of the rinse fill cycle. The fabric softener counter is reset at block 246 in preparation for the impending fabric softener addition procedure. The drive system for the washer is de-energized via blocks 247 and 248 which set the run/stop bit for output line 52 and the run/stop flag respectively.

If the rinse fill flag is not set at inquiry 241, the fabric softener addition procedure, of the Sprinse routine is executed. The procedure is designed to either operate an automatic dispenser or signal the user to add fabric softener to the rinse water. The fabric softener counter is incremented at block 249, and the counter is compared against a set time value at inquiry 250. If the counter is not greater than the set value, the program branches to block 251 where the fabric softener indicator, or actuator, is enabled. The program then jumps to the Update Display routine. If inquiry 250 determines that the time period for the fabric softener addition has elapsed, the fabric softener indicator, or actuator, is disabled at block 252. The fabric softener addition procedure is the last procedure of the Sprinse routine, so the sprinse flag is reset at block 253. Blocks 254–262 are used to set the washing machine into the proper configuration for the Spin Imbalance Reduction routine. The spin imbalance reduction flag is set at block 254, and the spin imbalance reduction counter is reset at block 255. The agit/spin bit for output line 53 and the agit/spin flag are reset at blocks 256 and 257 respectively to place the machine into an agitate mode. The asymmetric flag, used to indicate to the Interrupt routine (FIGS. 19 and 21) that an asymmetric waveform should be used, is set at block 258. The agitation inversion flag and the cycle counter, needed to implement the periodic inversion of the asymmetric waveform, are reset at blocks 259 and 260. The drive mechanism of the washing machine is activated by resetting the run/stop bit for output line 52 at block 261 and resetting the run/stop flag at block 262. The program then jumps to the Update Display routine.

Figure 15:
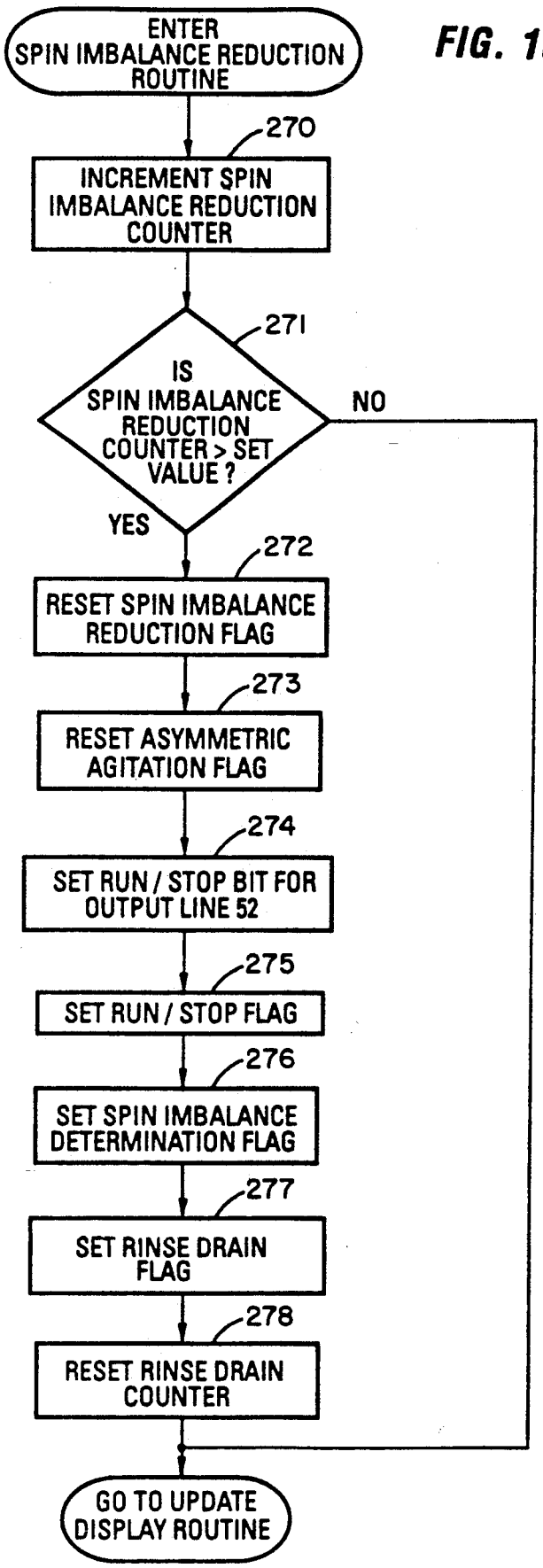
FIG. 15 is a simplified flow diagram of the Spin Imbalance Reduction routine incorporated in the control program of FIG. 12.

The Spin Imbalance Reduction routine, detailed in FIG. 15, operates the machine through a series of asymmetric agitation waveforms. FIG. 27 illustrates an exemplification imbalance waveform 426. It will be noted that the steady state speed is the same in both directions; however, the duration of the steady state speed is longer in one direction (waveform portion 427) than in the other direction (waveform portion 428). The waveform is inverted periodically so that the asymmetry first applies in one rotational direction and then the other. As described earlier, the asymmetric agitation is used to more evenly distribute the clothes load throughout the wash container. The periodic inversion helps prevent tangling and wrapping of clothes normally associated with the asymmetric agitation. The Spin Imbalance Reduction routine begins by incrementing the spin imbalance reduction counter at block 270. The counter is compared against a set time value at inquiry 271. If the counter has not reached the set value, the program jumps to the Update Display routine; otherwise, the program proceeds to block 272 where the spin imbalance reduction flag is reset. The asymmetric agitation flag is reset at block 273. The run/stop bit for output line 52 is set at block 274 and the run/stop flag is set at block 275 to de-energize the drive system. The spin imbalance determination flag is set at block 276, the rinse drain flag is set at block 277, and the rinse drain counter is reset at block 278 in preparation for the rinse drain procedure of the spin imbalance determination routine. The program then jumps to the Update Display routine.

Figure 16A:
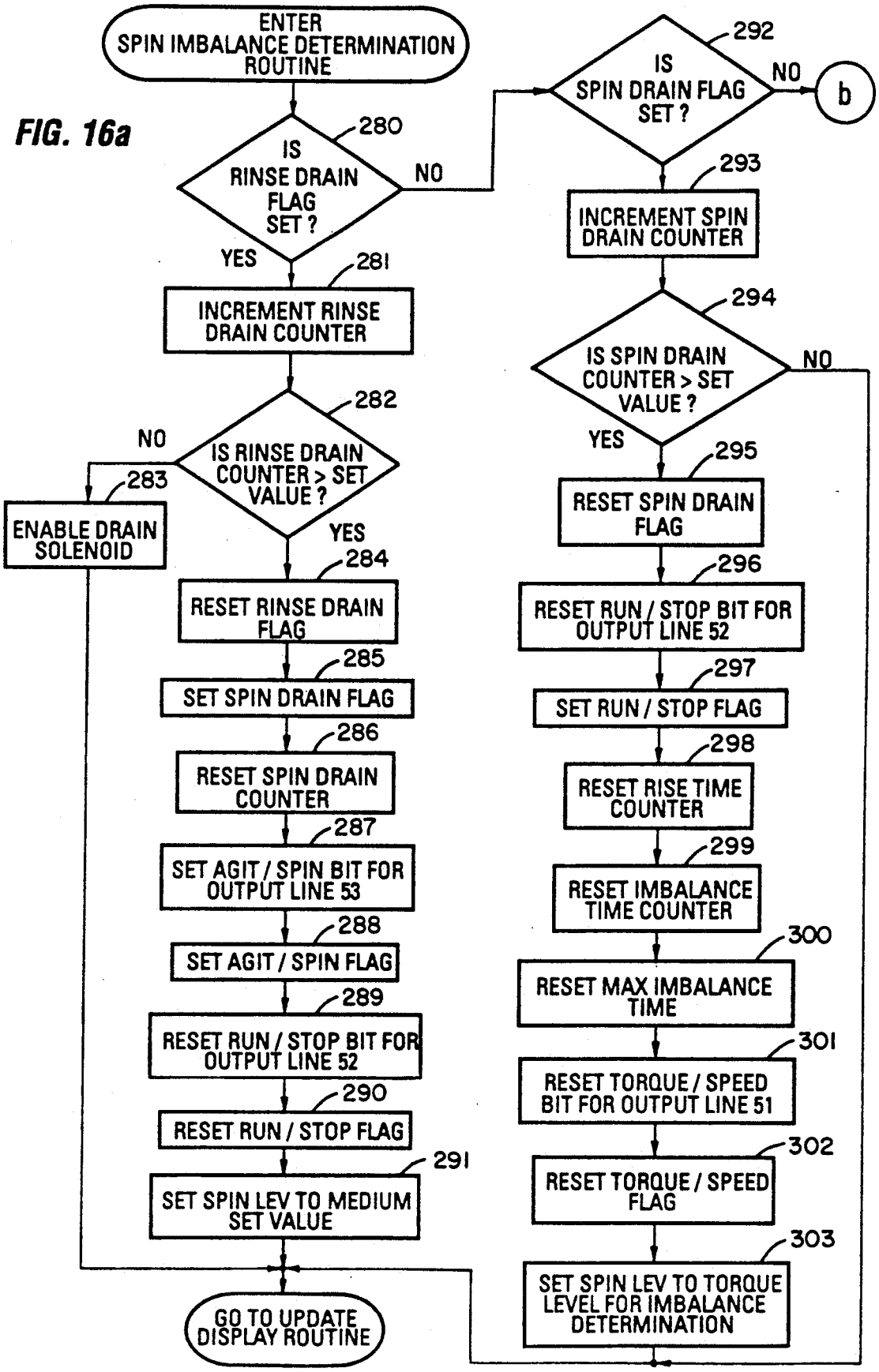
FIGS. 16*a* and 16*b* are a simplified flow diagram of the Spin Imbalance Determination routine incorporated in the control program of FIG. 12.
Figure 16B:
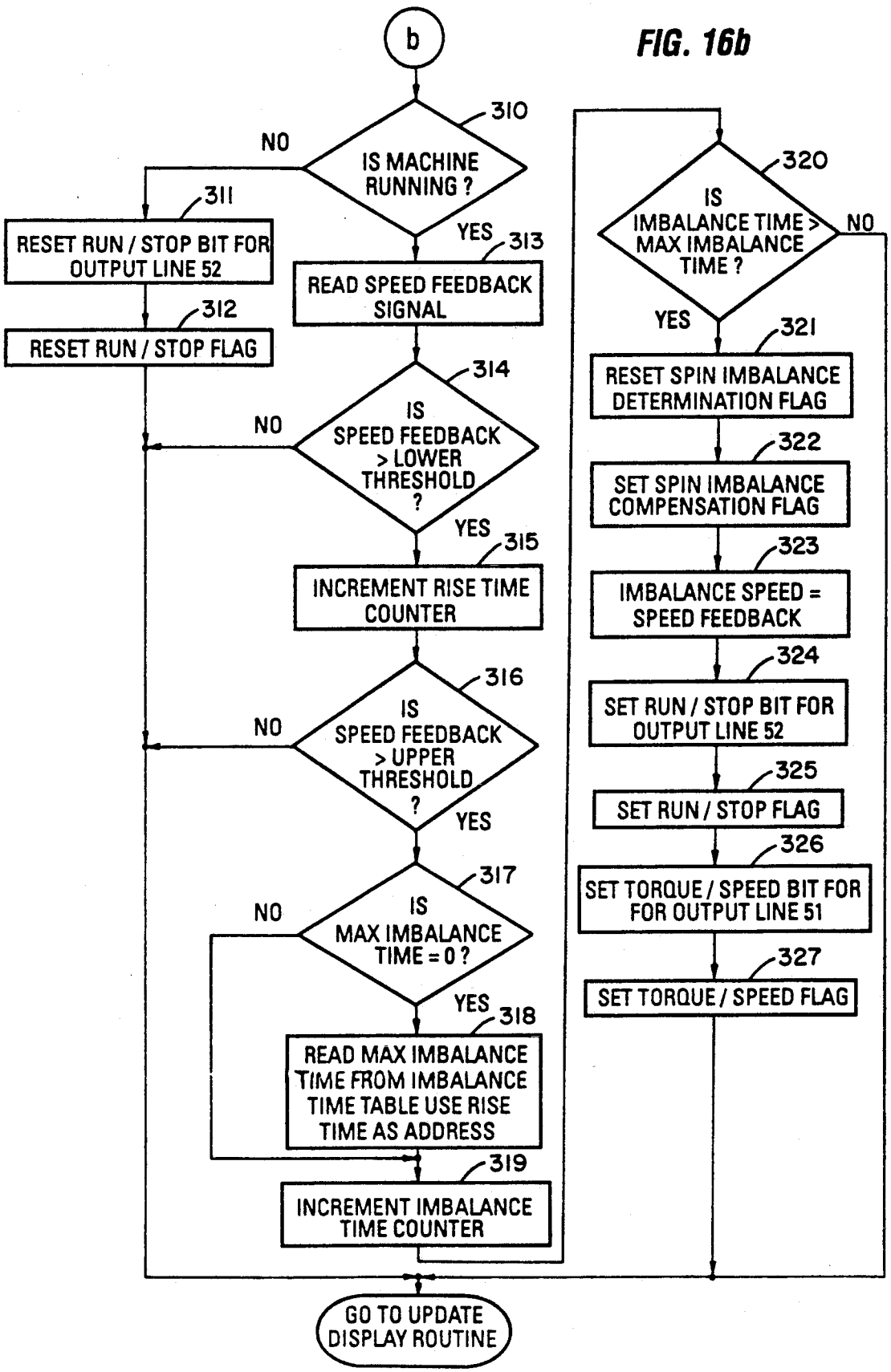

The spin imbalance determination routine, illustrated in FIGS. 16*a* and 16*b*, is entered at inquiry 280. If inquiry determines that the rinse drain flag is set, the program branches to block 281 where the rinse drain counter is incremented. The value of the rinse drain counter is then compared to a set time value at inquiry 282. If the counter is not greater, indicating that the drain time has not elapsed, the drain solenoid is enabled at block 283 and the program then jumps to the update display routine. If the rinse drain counter is greater than the set value, the rinse drain flag is reset at block 284. The spin drain flag is set at block 285 and the blocks 286–291 place the machine into the proper configuration for the spin drain. The spin drain counter, used to program the duration of the spin drain procedure of the spin imbalance determination routine, is reset at block 286. The agit/spin bit for output line 53 and the agit/spin flag are set at blocks 287 and 288 respectively in order to place the machine into a spin mode. The run/stop bit for output line 52 and the run/stop flag ar reset at blocks 289 and 290 respectively to energize the drive system. The spin level is set to a medium set value at block 291. The program then jumps to the Update Display routine.

If the rinse drain flag is not set at inquiry 280, the program branches to inquiry 292 where the status of the spin drain flag is checked. If the spin drain flag is set, the spin drain counter is incremented at block 293. The value of the spin drain counter is compared against set time value at inquiry 294. The drain solenoid was previously enabled and the machine was placed into a medium speed spin upon the completion of the rinse drain. If the counter is not greater than the set value, it means that the spin operation should continue and the program jumps to the Update Display routine. If the spin drain counter is greater than the set value, the program branches to block 295 from inquiry 294 to reset the spin drain flag. The run/stop bit for output line 52 and the run/stop flag are set at blocks 296 and 297 in order to de-energize the drive system. The rise time counter, the imbalance time counter, and the max imbalance time are reset at blocks 298, 299, and 300, respectively. The machine is set to operate in a torque based mode rather than a speed based mode by resetting the torque/speed bit for output line 51 and the torque/speed flag at blocks 301 and 302. Spin level is set to the set torque level required by the spin imbalance procedure at block 303. The program then jumps to the Update Display routine.

If the spin drain flag is not set at inquiry 292, then spin drain is complete and the program branches to inquiry 310 of FIG. 16*b* to determined if the machine is running at inquiry. If it is not running, the run/stop bit for output line 52 and the run/stop flag are reset at blocks 311 and 312. The program then jumps to the Update Display routine. If the machine is running at inquiry 310, the speed feedback signal is read at block 313, and is compared to the lower threshold speed of the wet load size portion of the spin imbalance determination routine at inquiry 314. If the feedback signal is less than the lower threshold, the program jumps from inquiry 314 to the Update Display routine. If the feedback signal is greater than the lower threshold, at inquiry 314, the wash container is rotating faster then the lower threshold and the rise time counter is incremented at block 315. The speed feedback is then compared against an upper threshold value at inquiry 316. If the speed feedback is not greater than the upper threshold, the program jumps to the Update Display routine. If the speed feedback is greater than the upper threshold at inquiry 316, the wet load size portion of the algorithm is complete. The rise time of the speed feedback signal from the lower to the upper threshold is representative of an approximation of the mass of the wet clothes load. Upon completion of the wet load size routine, the machine is allowed to continue to accelerate. This acceleration is no longer a function of the machine and the inertia of the clothes, it also is a function of the extent of the imbalance of the load. By measuring the speed of the basket after a predetermined length of time and checking it against a threshold, the load may be classified as to the extent of imbalance remaining in the load. A predetermined acceleration time (max imbalance time) is retrieved from an empirically determined lookup table as a function of the wet load size. Each max imbalance time is representative of the maximum amount of time that a clothes load of a particular weight or mass (wet) that is balanced sufficiently to spin at the terminal spin velocity requires to accelerate from a first predetermined speed (the upper threshold of the wet load size imbalance procedure), to a second higher predetermined speed (the upper imbalance speed threshold). Upon the completion of the drain portion of the Spin Imbalance Determination routine, the max imbalance time is reset to zero. This is so that it may be easily determined if the value appropriate for the size of the wet load undergoing examination has been placed into max imbalance time. If the max imbalance time is zero, the Spin Imbalance Determination routine uses the value of the wet load size to address a table containing max imbalance times. The corresponding value is retrieved and placed into max imbalance time. Once the maximum imbalance time is no longer zero, the routine will not retrieve a value from the table until max imbalance time is reset to zero. The max imbalance time is compared against zero at inquiry 317; if the max imbalance time is equal to zero, the value appropriate to the determined wet load size is retrieved from a lookup table at block 318. The program then continues with block 319 where the imbalance time counter is incremented. If the max unbalance time is not zero at inquiry 317, the program proceeds directly to block 319 to increment the imbalance time counter. The imbalance time is compared against the max imbalance time at inquiry 320. If the imbalance time is not greater, the unbalance determination procedure should continue and the program jumps to the Update Display routine. If the imbalance time is greater than the max imbalance time; the unbalance determination procedure is complete; the spin imbalance determination flag then is reset at block 321 and the spin imbalance compensation flag is set at block 322. The current speed of the basket is recorded as the imbalance speed at block 323. The drive means of the washer is de-energized via blocks 324 and 325 where the run/stop bit for output line 52 and the run/stop flag are set. The machine is placed into a speed driven mode by blocks 326 and 327 where the torque/speed bit for output line 51 and the torque/speed flag are set. The program then jumps to the Update Display routine.

Figure 17:
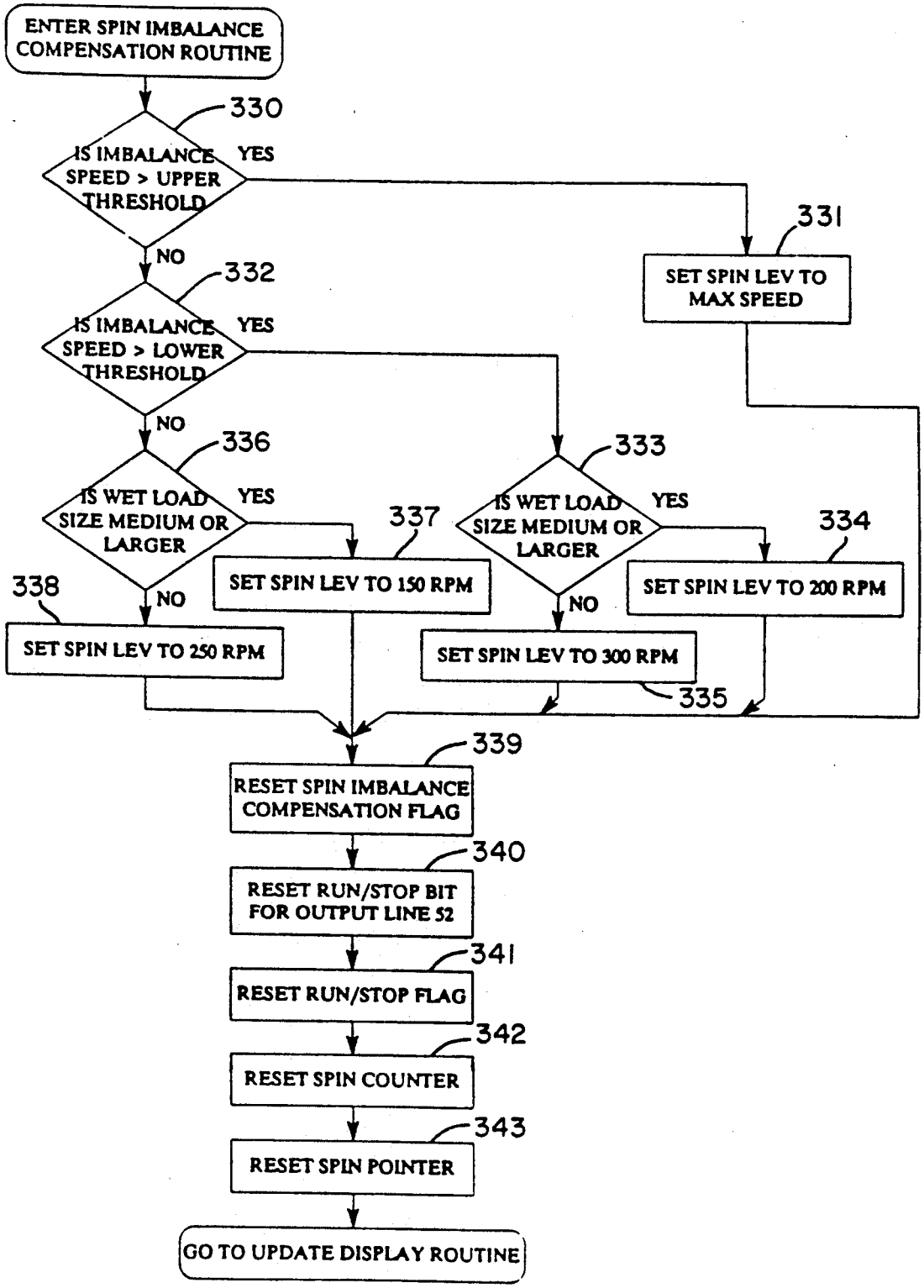
FIG. 17 is a simplified flow diagram of the Spin Imbalance Compensation routine incorporated in the control program of FIG. 12.
Figure 18:
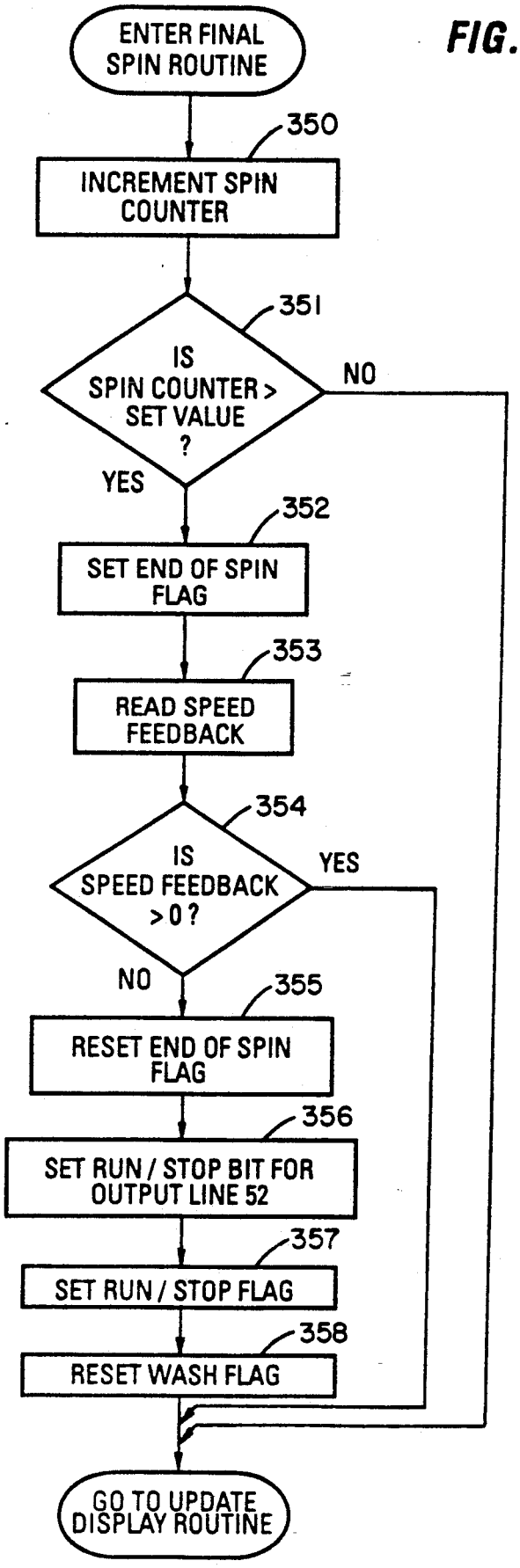
FIG. 18 is a simplified flow diagram of the Final Spin routine incorporated in the control program of FIG. 12.

The spin imbalance compensation routine is detailed in FIG. 17. The imbalance speed is compared against an upper spin imbalance threshold at inquiry 330. If the imbalance speed is greater than the upper spin imbalance threshold, the load is sufficiently balanced to spin at the maximum velocity and the program proceeds to block 331 where the spin level is set to the maximum speed. The program continues to block 339 where the spin imbalance compensation flag is reset. The program energizes the drive means by resetting the run/stop bit for output line 52 and the run/stop flag at blocks 340 and 341. The spin counter, used to program the duration of the final spin, is reset at block 342, and the spin pointer, used to address the spin lookup table, is reset at block 343. From block 343, the program jumps to the Update Display routine.

If the imbalance speed is not greater than the upper spin imbalance threshold at inquiry 330, the load is too unbalanced to spin at the maximum velocity and the program proceeds to inquiry 332 where the imbalance speed is compared to a lower spin imbalance threshold value. If the imbalance speed is greater than this threshold, the load is sufficiently balanced to spin at a level above the first critical frequency of the suspension but below the second critical frequency and the program proceeds to inquiry 333 where the wet load size is compared against a threshold for medium or larger loads. If the wet load size is greater, the spin level is set to a medium low speed of 200 RPM at block 334. If the wet load size is less than the medium or large threshold at inquiry 333, the spin level is set to a medium high speed of 300 RPM at block 335. The program continues to block 339 after either of blocks 334 or 335. When inquiry 332 determines that the imbalance speed is not greater than the lower spin imbalance threshold at inquiry 332 it indicates that the imbalance is of such a nature that the load cannot spin above the first critical frequency. In that event the program goes from inquiry 332 to inquiry 336, where the wet load size is compared against a threshold for medium or larger loads. If the wet load size is greater, the spin level is set to low speed of 150 RPM at block 337. If the wet load size is less than the threshold, the spin level is set to a medium speed of 250 RPM at block 338. The program continues to block 339 after either of block 337 or 338.

Figure 28:
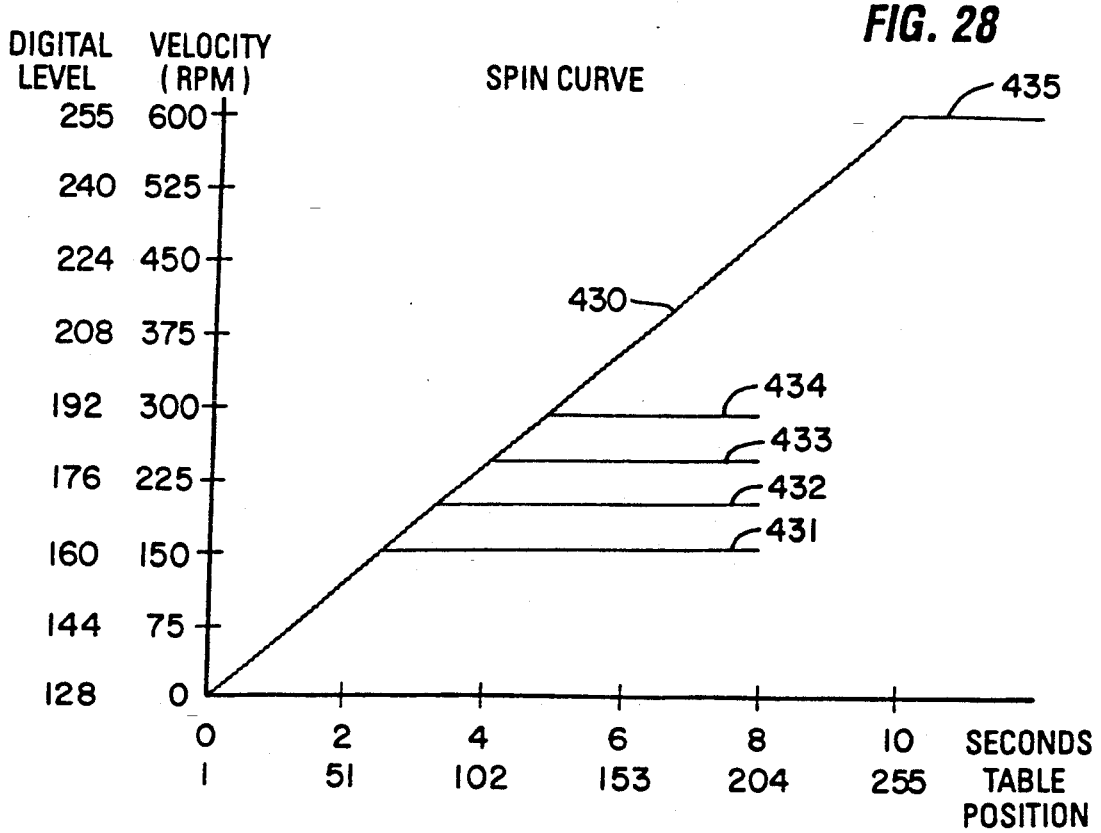
FIG. 28 illustrates an exemplification rotor velocity wave shape for centrifugally extracting fluid from clothes loads.

FIG. 32 illustrates the decision matrix used to set the terminal spin speed or level based on the wet load size (weight) and the level or amount of residual unbalance. Assume the wet load size has been determined to be mini or small. A terminal spin speed of 250 RPM is selected when it is determined the residual unbalance is too large for the machine to pass through its slowest resonance speed (lower threshold). A terminal spin speed of 300 RPM is selected when it is determined that the residual unbalance is not too large for the machine to pass through its slowest resonance speed but is too large for it to pass through the next faster resonance speed (upper threshold). When it is determined that the machine will pass through the upper threshold speed, it is programmed for the terminal speed of the spin look-up table. Similarly a medium or large wet load size, the decision matrix of FIG. 32 will provide a terminal spin speed of 150 RPM, 200 RPM or the spin look-up table terminal speed, depending upon the residual unbalance. FIG. 28 is a graph of the spin speeds corresponding to the matrix of FIG. 32. It will be noted that spin acceleration follows the same path 430 regardless of the terminal speed. However, the steady state terminal speed may be 150 RPM (431), 200 RPM (432), 250 RPM (433), 300 RPM (434) or 600 RPM (435) depending on the decision reached at the matrix of FIG. 32.

It will be understood that other matrices may be used. For example, each load size range (mini, small, medium or large) could have its own progression of terminal speeds.

Upon completion of the Spin Imbalance Compensation routine, the program proceeds to the Final Spin routine described in FIG. 8. This routine is executed at the end of a complete washing operation in order to provide the necessary dehydration of the clothes load and to reset the machine to prepare for the next washing operation. The spin counter, used to program the length of the spinning action, is incremented at block 350. The spin counter may be set to a fixed value, or it may be adjusted to load size, imbalance, or any other pertinent parameter. The value of the spin counter is compared to a set value at inquiry 351. If the spin counter is not greater, indicating that the spin cycle is not yet complete, the program jumps to the Update Display routine. When the spin counter is greater than the set value, the spin cycle is complete and the program proceeds to block 352 where the end of spin flag, used to communicate to the Brake routine that a braking action is required, is set. The speed feedback is read at block 353 and compared to zero at inquiry 354. While the basket is still moving, the speed feedback is greater than zero and the program branches from inquiry 35 to the Update Display routine. If the Brake routine has stopped the basket from spinning, the speed feedback is not greater than zero and the program proceeds from inquiry 354 to block 355 where the end of spin flag is reset. The run/stop bit for output line 52 and the run/stop flag are reset at block 356 and 357, respectively. To indicate completion of the washing operation, the wash flag is reset at block 358 and the program proceeds to the Update Display routine.

The Update Display routine (block 67 in FIG. 4) updates the lights 20 (FIG. 1) by means of updating the VF display module 47 (FIG. 3). Details of this routine have been omitted as there are a number of well known such routines and it forms no part of the present invention.

The overall Operation routine, as generally set forth in FIG. 4, has been described and it will be understood that the most time-consuming path through the operation routine takes less than the 8.33 milliseconds between successive zero crossings of the power supply voltage. Thus, the program accomplishes a complete pass through the Operation routine of FIGS. 4 and 6–18 and the control then waits for the next zero crossing to repeat the operation. Each fill, agitate, drain and spin operation of the machine continues for several minutes. Thus, the routine of FIGS. 4 and 6–18 will be implemented many times during each operation or operational phase of the washing machine. During each pass through the program the appropriate components of the machine, such as the motor, the fill solenoid and the drain solenoid, for example, are energized and the appropriate ones de-energized and the appropriate counters are incremented once for each pass through the program. When energized, the solenoids maintain their related components energized. For example, the machine will drain continuously during a drain operation even though the laundry control makes repeated passes through the program with pauses between successive passes until the next zero cross. As previously described, when the control senses that the appropriate counter has exceeded its set value, it branches to the next subroutine which is then repeated a number of times until the set value for that routine is exceeded.

A typical operational sequence of an automatic washing machine incorporating a preferred embodiment of the present invention includes a first phase of fill, wash agitation, drain, sprinse, spin imbalance reduction, spin imbalance determination, spin imbalance compensation and a final spin.

As previously described, a number of sets of agitation or wash values are stored in the form of look up tables in the ROM of microprocessor 40 and are called up by the microprocessor so that control 25 operates motor 14 at a speed corresponding to the current or last called up value. As an example, in the machine and control of the illustrative embodiment there are four sets of empirically determined wash values, called mini, small, medium, and large load sizes for reference which control the motor to provide wash or agitation operation. Appendix A includes sets of wash values for a mini load; Appendix B includes sets of wash values for a small load; Appendix C includes sets of wash values for a medium load; and Appendix D includes sets of wash values for a large load. Each set of values includes 256 different numbers from 0 to 255 inclusive. In each set of values the number 128 has been chosen to represent zero angular velocity of the motor rotor, the number 0 to represent the maximum angular velocity in one direction and the number 255 to represent the maximum angular velocity in the other direction. It will be understood that the values or numbers 0–255 are stored in the ROM memory in a binary (hexadecimal) form and, when stored, each set of values provides a look up table. When called up from memory by the microprocessor 40, the value is transmitted to the command latch 54 which sends the speed command to the motor control 27. Each of the numbers 0–255 corresponds to a particular 8-bit parallel output from the microprocessor 40 to the command latch 54. For example, the number or value 0 is 0000 0000; the number 128 is 1000 0000 and the number 255 is 1111 1111. The conversion factor built into motor control 27 is such that, for agitation operations, the number 255 corresponds to 150 revolutions per minute counter-clockwise, and the number 0 corresponds to 150 revolutions per minute counter-clockwise.

The set of values or look-up table for each load size is stored as eight bit bytes in the ROM of microprocessor 40 in 256 separate locations. A pointer for each set incorporated in the microprocessor initially points to the first value of that set. When that value is called up, the pointer is incremented to the next value and when the last value is called up the pointer is incremented to the initial value. In this way the values of the selected set of values or look-up table are repeatedly called up in sequence throughout an agitation cycle.

Another set of empirically determined values, conveniently called spin values, are stored in the form of a spin look up table in another portion of the ROM are called up by the microprocessor in a predetermined timed sequence and used to control the motor to provide a spin or centrifugal extraction operation in a manner generally as explained for the agitation operation. Appendix E is an exemplary set of spin values. It will be noted from Appendix E and the corresponding speed curve of FIG. 28 that the spin curve accelerates in a number of small steps or increments to a maximum speed which then is held constant. The spin table contains a set of values or numbers that range from 128 to 255, inclusive, and each number represents an 8-bit parallel output from the microprocessor to the command latch, as explained hereabove for the agitation operation. The conversion factor built into the motor control 27 is such that, for the spin operation, the number 128 corresponds to zero revolutions per minute, and the number 255 corresponds to 600 revolutions per minute of the motor rotor and basket.

In the illustrative embodiment the terminal speed provided by the set of spin values in Appendix E (600 RPM) is used to provide spin for balanced loads. When the control determines that the load is unbalanced, a lower terminal spin level is set into the memory of the microprocessor. As will be explained more fully hereinafter, each time the microprocessor calls up a spin value from the spin table, it then compares the spin value to the terminal spin level set in accordance with the load size and amount of unbalance or imbalance of the wet fabric load and operates the motor at a speed corresponding to the value representative of the lower speed.

In the illustrative embodiments, during the agitation cycle, individual values are called up 256 times during one complete oscillation or agitation stroke of the motor 14 and basket 11. After the subsequent spin system routines, the final spin cycle is implemented and individual values are called up from the spin table to bring the basket up to its terminal velocity.

In final spin operation, individual values are called up a maximum of 256 times during the acceleration or ramp up phase. After that a constant value is used to provide a constant terminal speed of the basket 11. Terminal speed operation continues until the spin counter times out the spin extraction operation (block 351, FIG. 18). In a basic control the interrupt timer for the spin operation is preset so that the acceleration or ramp up phase of spin operation follows the same slope regardless of imbalance. In another embodiment the value preset in the interrupt timer is a function of the imbalance. In that event the ramp up rate for spin is tailored to the imbalance.

The time period between (or frequency of) successive call ups of agitate or spin values is implemented by an interrupt timer or counter in the microprocessor 40. The interrupt timer causes the microprocessor to interrupt the main Operation routine of FIG. 4 and enter the Interrupt routine of FIG. 5 at predetermined intervals. The illustrative interrupt timer has a predetermined maximum value and an initial value is set by the control depending upon the load size. At a rate set by the internal clock of the microprocessor, the interrupt timer increments from the initial value to the maximum value. When the maximum value is reached, the Operation routine is interrupted and the Interrupt routine is entered. The interrupt timer is repeatedly reloaded with the initial value and times out throughout the agitation, drain and spin operations. It will be understood that, if desired, the interrupt timer could decrement from an initial value to zero.

Figure 19:
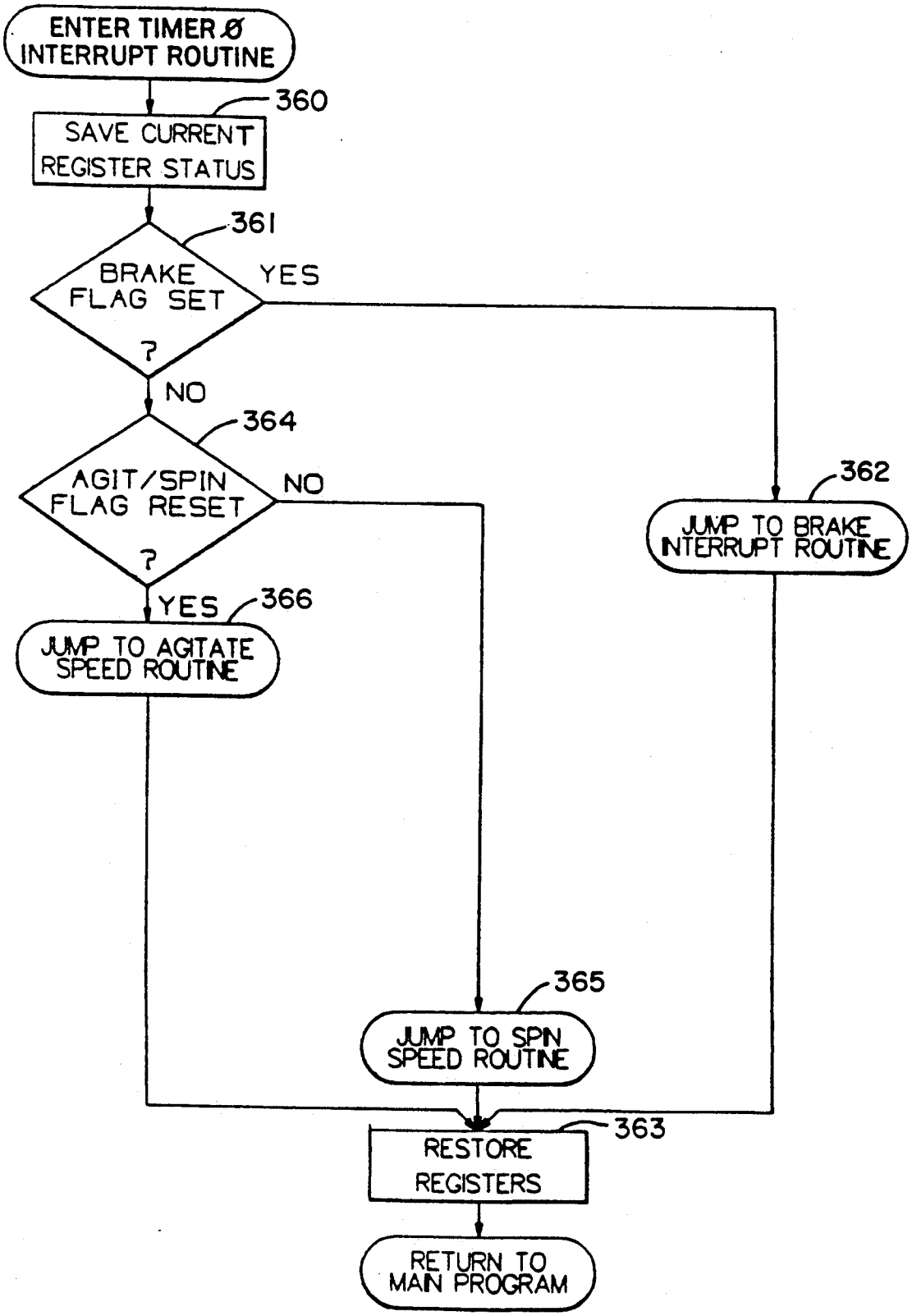
FIG. 19 is a simplified flow diagram of the Timer 0 Interrupt routine incorporated in the control program of FIG. 4.

A more detailed explanation of the Timer 0 interrupt operation or routine is illustrated beginning with FIG. 19. Referring to FIG. 19, when the Timer 0 Interrupt routine is entered the status of each of the registers in the control as heretofore described is saved at block 360. Inquiry 361 then determines whether the brake flag is set. If the brake flag is set, indicating that the brake mode is active, the program jumps to the Brake Interrupt routine, FIG. 20, as indicated at 362. At the end of each of the Brake interrupt routine, the program returns to block 363, where the registers are restored and the control then returns to the main program. If inquiry 361 determines that the brake flag is not set, the control knows that the brake mode is not active. The program continues to inquiry 364 which determines whether the agit/spin flag is set. It will be remembered that the set status of the agit/spin flag equates to a spin operation and the reset status of the agit/spin flag equates to an agitate operation. Thus when inquiry 364 determines that the agit/spin flag is set the program jumps to the Spin Speed routine as indicated at 365. Upon completion of that routine, all the registers and counters are restored at block 363 and the control then returns to the Main operation or routine. When inquiry 364 determines that the agit/spin flag is reset, the program jumps to the Agitate Speed routine as indicated in 366. When the Agitate Speed routine is completed, the registers and counters are restored at block 363 and the control returns to the main program.

Figure 20:
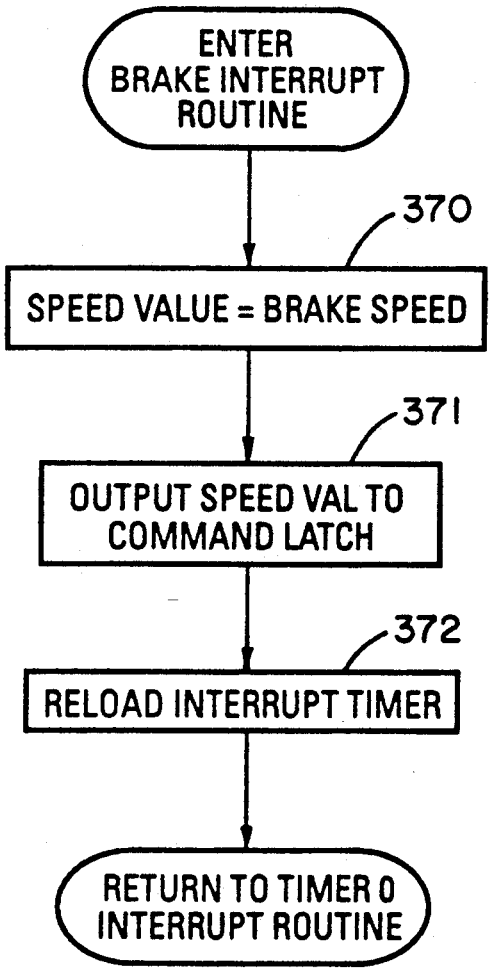
FIG. 20 is a simplified flow diagram of the Brake Interrupt routine incorporated in the control program of FIG. 4.

The Brake Interrupt routine, shown in FIG. 20, derives the appropriate speed value from the brake speed generated in the Brake routine shown in FIG. 9. The speed value is set to the inverse (same magnitude, but opposite direction) of the brake speed in block 370. The speed value is then written to the command latch at block 371. The interrupt timer is reloaded at block 372 and the program then returns to the Timer 0 Interrupt routine at block 362 (FIG. 19).

Figure 21:
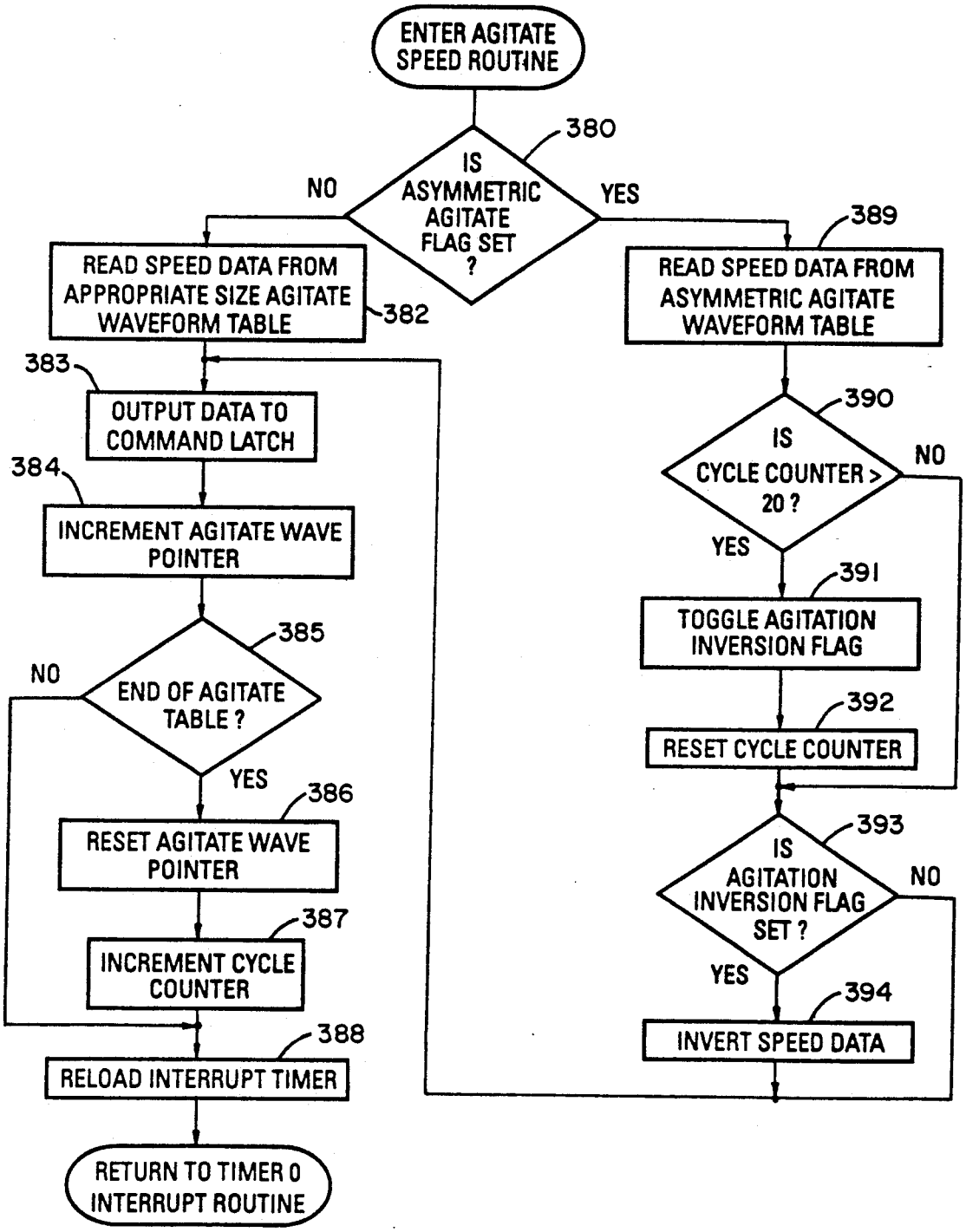
FIG. 21 is a simplified flow diagram of the Agitate Speed routine incorporated in the control program of FIG. 4.

FIG. 21 illustrates the Agitate Speed routine. The status of the asymmetric agitate flag is determined at inquiry 380. If the asymmetric flag is not set, the data from the waveform table selected by the user size selector switch is read at block 382. The data is outputted to command latch 54 at block 383; the agitate waveform pointer is incremented at block 384 and inquiry 385 determines whether the end of the agitate waveform table has been reached. If yes, the agitate waveform pointer is reset to the beginning of the table at block 386; the cycle counter is incremented at block 387; the initial value is reloaded into the interrupt timer at block 388; and the program returns to the Timer 0 Interrupt routine at block 365 (FIG. 19). If, at inquiry 385, the end of the agitate waveform table has not been reached, the initial value is reloaded into the interrupt timer at 388 and the program returns to the Timer 0 Interrupt routine.

Returning to inquiry 380, if the asymmetric agitate flag is set, the control reads the data from the asymmetric agitate waveform table at block 389. Then the status of the cycle counter is checked at inquiry 390. If the cycle counter is greater than 20, then the appropriate number of cycles before an inversion of the asymmetry has been reached. In that event, the agitation inversion flag is toggled at block 391 and the cycle counter is reset 392; that is, if the agitation inversion flag is set, it is then reset, on the other hand, if the agitation inversion flag is reset, then it is set; and the program proceeds to inquiry 393. Returning to inquiry 390, if the cycle counter is not greater than 20, the program jumps directly to inquiry 393. The status of the agitate inversion flag is determined at inquiry 393. If the flag is not set, the program branches to block 383 and continues as previously described. If the agitate inversion flag is set, the speed data is inverted at block 394. The inversion is carried out by a bitwise inverting operator of the speed data. If a bit is a 1, then it becomes a 0; if a bit is a 0, then it becomes a 1. This changes the direction information of the data yet maintains the magnitude of the speed. The program then branches to block 383 and continues as previously described.

Appendix F illustrates a lookup table for the asymmetric agitation stroke illustrated in FIG. 27, in which the clockwise movement is greater than the counter-clockwise portion. Periodically the asymmetric stroke is reversed. As explained previously, this can be accomplished by inverting the images called up from the table of Appendix F. Alternatively another table of values can be stored in the ROM and used for the reversed asymmetric stroke.

Figure 22:
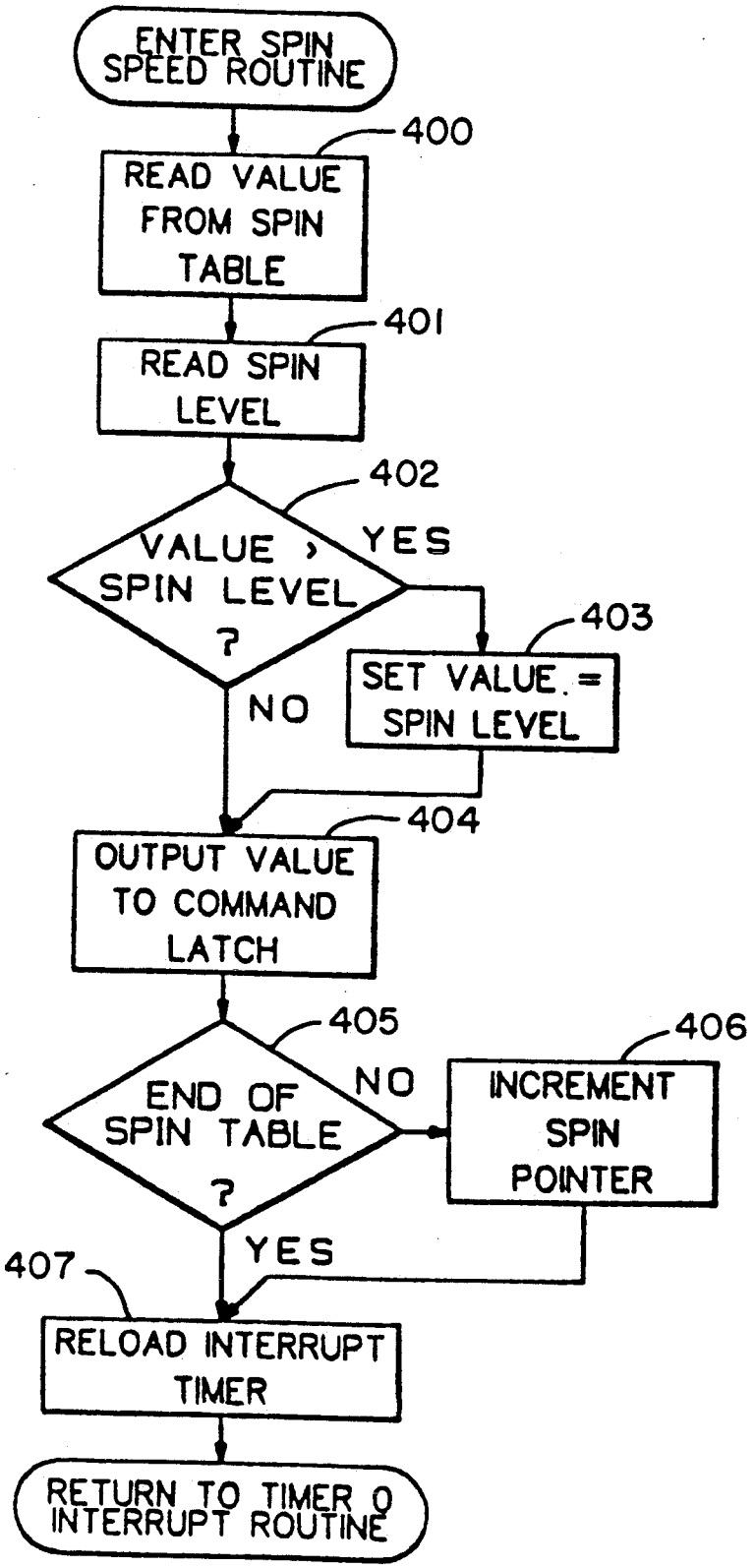
FIG. 22 is a simplified flow diagram of the Spin Speed routine incorporated in the control program of FIG. 4.

When the Spin Speed routine illustrated in FIG. 22 is entered, the next value from the spin table is read at block 400 and the control determined maximum spin level is read at block 401. (The maximum spin level conforms to the imbalance as determined by the Spin Imbalance Compensation routine.) Inquiry 402 determines whether the value read from the spin table at block 400 is greater than the spin level read at block 401. If yes the spin value is set to equal the spin level at block 403 and this value is outputted to the command latch at block 404. If inquiry 402 determines that the spin value from block 400 is not greater than the spin level from block 401 the spin value, without change, is outputted to the command latch at block 404. This assures that the actual spin speed does not exceed the predetermined maximum level. Output of the spin value at block 404 provides a speed control signal to the motor to provide a spin or centrifugal extraction operation. Inquiry 405 determines whether the end of the spin table has been reached. If yes, the initial value is reloaded into the interrupt timer at block 407 and the program returns to the Timer 0 Interrupt routine at block 366 in FIG. 19. If the end of the spin table has not been reached, then the spin pointer is incremented at block 406; the initial value is reloaded into the interrupt timer at block 407 and the program then returns to the Timer 0 Interrupt routine. The dual path from inquiry 402 to block 404 provides a control in which the motor and basket are accelerated up essentially the same curve regardless of the load size or fabric blend but the constant terminal speed varies depending upon the desired speed selected by the user or the automatic routine. In the illustrative example this terminal speed is tied to the imbalance measurement or determination made by the machine.

Figure 23:
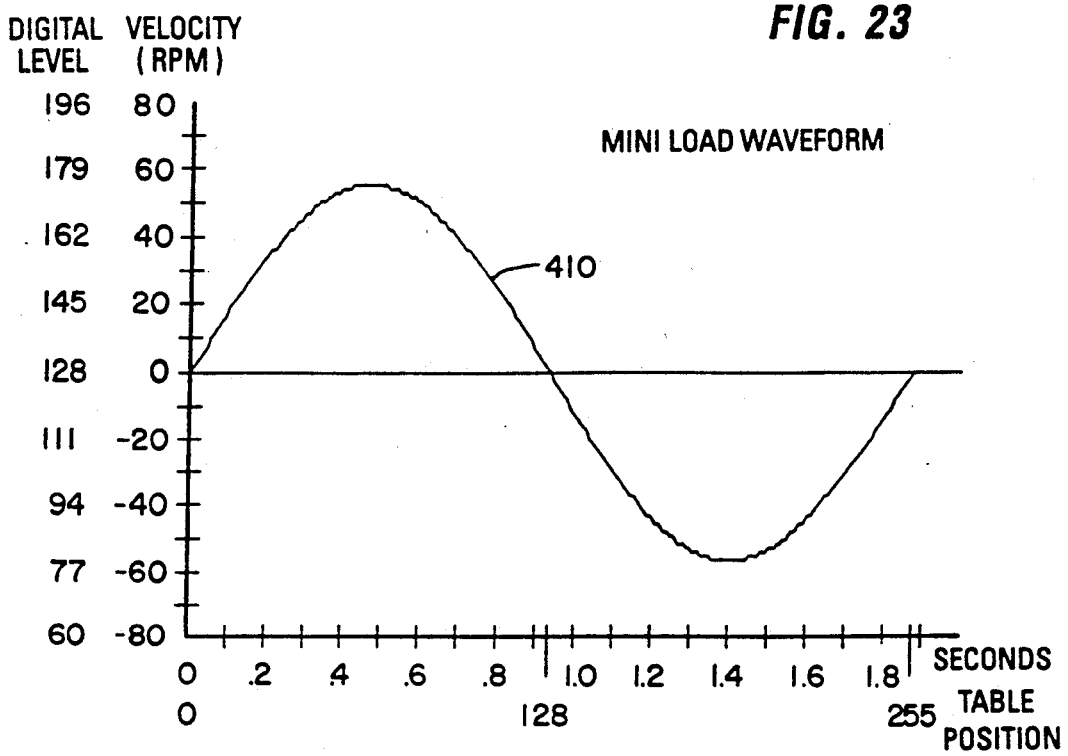
FIG. 23 illustrates an exemplification rotor wave shape for agitation of a mini clothes load.

Referring now to the washer agitate tables, Appendices A–D inclusive, and to FIGS. 23–26, several aspects of the illustrative washer and control will become more apparent. FIGS. 23–26 illustrate rotor and basket or container angular velocities corresponding to the value sets or look up tables of Appendices A–D respectively. In each of FIGS. 23–26 the horizontal axis represents time and the memory lookup table position of particular values. The vertical axis is the velocity in RPM and the direction, with + values corresponding to clockwise and − values corresponding to counter-clockwise movement. In addition, the equivalent digital values of the 8 bit bytes stored in the lookup tables and corresponding to velocities are indicated on the vertical axis. Referring particularly to FIG. 23, where velocity curve 410 corresponds to the mini load. The velocity curve 410 is essentially sinusoidal, although the curve consists of a discrete number (256) of steps corresponding to the values sequentially called up from the lookup table. In just under half a second the motor and basket reach a peak speed of about 55 RPM in a first, or clockwise, direction. At just over 0.9 seconds the motor and basket decelerate to zero speed. At just under 1.4 seconds the motor and basket accelerate to a peak speed of about 55 RPM in the other, or counter-clockwise, direction and at just under 1.9 seconds the motor and basket decelerate to zero angular velocity, finishing one complete stroke.

Figure 24:
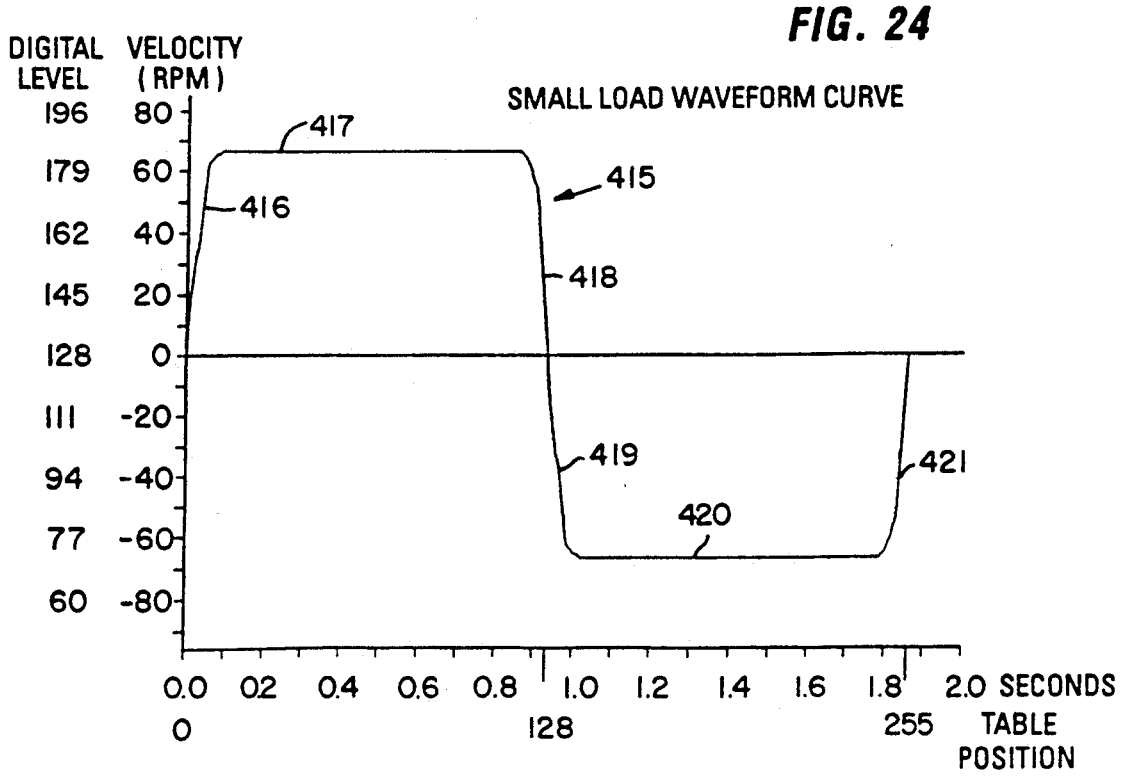
FIG. 24 illustrates an exemplification rotor velocity wave shape for agitation of a small clothes load.

By contrast the exemplification small load wash stroke illustrated in FIG. 24, where velocity curve 415 corresponds to the small load. These curves include an acceleration in the first direction phase 416; constant speed in the first direction phase 417; deceleration in the first direction phase 418; acceleration in the other direction phase 419; constant speed in the other direction phase 420 and deceleration in the other or second direction phase 421.

Figure 25:
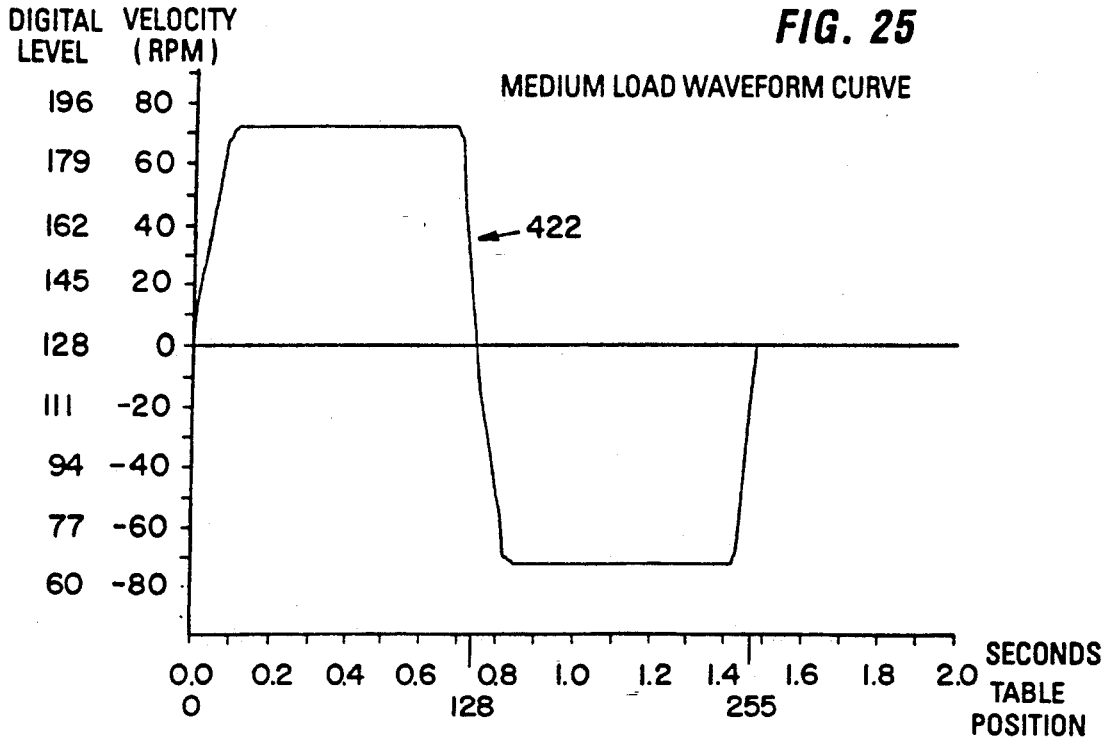
FIG. 25 illustrates an exemplification rotor velocity wave shape for agitation of a medium clothes load.

Corresponding phases of the velocity curves for medium loads of various blends are detailed in FIG. 25, where velocity curve 422 corresponds to the medium load. Corresponding phases of the velocity curves for large loads are detailed in FIG. 26, where velocity curve 425 corresponds to the large load.

The illustrative embodiments of this invention illustrated and described herein incorporate a control which operates the machine to redistribute unbalanced loads, determine the size of imbalances, adjust the spin speed to best fit the conditions and provide controlled regenerative braking in the automatic washer. The illustrative washing machine includes a basket or container which is directly driven by a SRM for oscillation and unidirectional rotation. However, it will be apparent that various aspects of this invention have broader application. For example certain aspects of the invention are applicable to washing machines having other motors, particularly other types of electronically commutated motors. Also various aspects of this invention are applicable to washing machines which have separate agitators or means other than an oscillating basket to impart agitation motion and energy to the fabrics and fluid. In addition, each of the imbalance and brake aspects of this invention can be implemented independent of the other aspect. It will be apparent to those skilled in the art that, while I have described what I presently consider to be the preferred embodiments of my invention in accordance with the patent statutes, changes may be made in the disclosed embodiments without departing from the true spirit and scope of the invention.

APPENDIX A

MINI LOAD DIGITAL WAVEFORM

| | | | | | | | | | | | | | | | | |
|---|---|---|---|---|---|---|---|---|---|---|---|---|---|---|---|---|
| 128 | 129 | 130 | 131 | 133 | 134 | 135 | 136 | 137 | 138 | 139 | 141 | 142 | 143 | 144 | 145 | |
| 146 | 147 | 148 | 149 | 150 | 151 | 152 | 153 | 154 | 155 | 156 | 157 | 158 | 159 | 160 | 160 | |
| 161 | 162 | 163 | 164 | 164 | 165 | 166 | 166 | 167 | 168 | 168 | 169 | 169 | 170 | 170 | 171 | |
| 171 | 172 | 172 | 173 | 173 | 173 | 174 | 174 | 174 | 174 | 174 | 175 | 175 | 175 | 175 | 175 | |
| 175 | 175 | 175 | 175 | 175 | 175 | 174 | 174 | 174 | 174 | 174 | 173 | 173 | 173 | 172 | 172 | |
| 171 | 171 | 170 | 170 | 169 | 169 | 168 | 168 | 167 | 166 | 166 | 165 | 164 | 164 | 163 | 162 | |
| 161 | 160 | 160 | 159 | 158 | 157 | 156 | 155 | 154 | 153 | 152 | 151 | 150 | 149 | 148 | 147 | |
| 146 | 145 | 144 | 143 | 142 | 141 | 139 | 138 | 137 | 136 | 135 | 134 | 133 | 131 | 130 | 129 | |
| 128 | 127 | 126 | 125 | 123 | 122 | 121 | 120 | 119 | 118 | 117 | 115 | 114 | 113 | 112 | 111 | |
| 110 | 109 | 108 | 107 | 106 | 105 | 104 | 103 | 102 | 101 | 100 | 99 | 98 | 97 | 96 | 96 | |
| 95 | 94 | 93 | 92 | 92 | 91 | 90 | 90 | 89 | 88 | 88 | 87 | 87 | 86 | 86 | 85 | |
| 85 | 84 | 84 | 83 | 83 | 83 | 82 | 82 | 82 | 82 | 82 | 81 | 81 | 81 | 81 | 81 | |
| 81 | 81 | 81 | 81 | 81 | 81 | 82 | 82 | 82 | 82 | 82 | 83 | 83 | 83 | 84 | 84 | |
| 85 | 85 | 86 | 86 | 87 | 87 | 88 | 88 | 89 | 90 | 90 | 91 | 92 | 92 | 93 | 94 | |
| 95 | 96 | 96 | 97 | 98 | 99 | 100 | 101 | 102 | 103 | 104 | 105 | 106 | 107 | 108 | 109 | |
| 110 | 111 | 112 | 113 | 114 | 115 | 117 | 118 | 119 | 120 | 121 | 122 | 123 | 125 | 126 | 127 | |

APPENDIX B

SMALL LOAD DIGITAL WAVEFORM

| | | | | | | | | | | | | | | | | |
|---|---|---|---|---|---|---|---|---|---|---|---|---|---|---|---|---|
| 128 | 141 | 149 | 152 | 160 | 168 | 175 | 183 | 185 | 187 | 188 | 189 | 189 | 190 | 190 | 191 | |
| 191 | 191 | 191 | 191 | 191 | 191 | 191 | 191 | 191 | 191 | 191 | 191 | 191 | 191 | 191 | 191 | |
| 191 | 191 | 191 | 191 | 191 | 191 | 191 | 191 | 191 | 191 | 191 | 191 | 191 | 191 | 191 | 191 | |
| 191 | 191 | 191 | 191 | 191 | 191 | 191 | 191 | 191 | 191 | 191 | 191 | 191 | 191 | 191 | 191 | |
| 191 | 191 | 191 | 191 | 191 | 191 | 191 | 191 | 191 | 191 | 191 | 191 | 191 | 191 | 191 | 191 | |
| 191 | 191 | 191 | 191 | 191 | 191 | 191 | 191 | 191 | 191 | 191 | 191 | 191 | 191 | 191 | 191 | |
| 191 | 191 | 191 | 191 | 191 | 191 | 191 | 191 | 191 | 191 | 191 | 191 | 191 | 191 | 191 | 191 | |
| 190 | 190 | 189 | 189 | 188 | 187 | 185 | 183 | 181 | 179 | 171 | 164 | 160 | 152 | 145 | 135 | |
| 128 | 115 | 107 | 100 | 96 | 88 | 81 | 73 | 71 | 69 | 68 | 67 | 67 | 66 | 66 | 65 | |
| 65 | 65 | 65 | 65 | 65 | 65 | 65 | 65 | 65 | 65 | 65 | 65 | 65 | 65 | 65 | 65 | |
| 65 | 65 | 65 | 65 | 65 | 65 | 65 | 65 | 65 | 65 | 65 | 65 | 65 | 65 | 65 | 65 | |
| 65 | 65 | 65 | 65 | 65 | 65 | 65 | 65 | 65 | 65 | 65 | 65 | 65 | 65 | 65 | 65 | |
| 65 | 65 | 65 | 65 | 65 | 65 | 65 | 65 | 65 | 65 | 65 | 65 | 65 | 65 | 65 | 65 | |
| 65 | 65 | 65 | 65 | 65 | 65 | 65 | 65 | 65 | 65 | 65 | 65 | 65 | 65 | 65 | 65 | |
| 66 | 66 | 67 | 67 | 68 | 69 | 71 | 73 | 76 | 79 | 87 | 95 | 99 | 107 | 115 | 128 | |

APPENDIX C

MEDIUM LOAD DIGITAL WAVEFORM

| | | | | | | | | | | | | | | | | |
|---|---|---|---|---|---|---|---|---|---|---|---|---|---|---|---|---|
| 128 | 135 | 141 | 145 | 149 | 152 | 156 | 160 | 164 | 168 | 171 | 175 | 179 | 183 | 187 | 187 | |
| 189 | 191 | 192 | 193 | 193 | 194 | 194 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 194 | 194 | 193 | 193 | 192 | 191 | 189 | 187 | 174 | 165 | 157 | 149 | 141 | 135 | |
| 128 | 121 | 115 | 111 | 107 | 104 | 100 | 96 | 92 | 88 | 84 | 81 | 77 | 73 | 69 | 68 | |
| 66 | 64 | 63 | 62 | 62 | 61 | 61 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 61 | 61 | 62 | 62 | 63 | 64 | 66 | 68 | 74 | 82 | 90 | 99 | 107 | 115 | 121 | 128 | |

APPENDIX D

LARGE LOAD DIGITAL WAVEFORM

| | | | | | | | | | | | | | | | | |
|---|---|---|---|---|---|---|---|---|---|---|---|---|---|---|---|---|
| 128 | 135 | 141 | 145 | 149 | 152 | 156 | 160 | 164 | 168 | 171 | 175 | 179 | 183 | 187 | 187 | |
| 189 | 191 | 192 | 193 | 193 | 194 | 194 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 194 | 194 | 193 | 193 | 192 | 191 | 189 | 187 | 174 | 165 | 157 | 149 | 141 | 135 | |
| 128 | 121 | 115 | 111 | 107 | 104 | 100 | 96 | 92 | 88 | 84 | 81 | 77 | 73 | 69 | 68 | |
| 66 | 64 | 63 | 62 | 62 | 61 | 61 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 61 | 61 | 62 | 62 | 63 | 64 | 66 | 68 | 74 | 82 | 90 | 99 | 107 | 115 | 121 | 128 | |

APPENDIX E

SPIN TABLE

-continued

| | | | | | | | | | | | | | | | | |
|---|---|---|---|---|---|---|---|---|---|---|---|---|---|---|---|---|
| 128 | 128 | 129 | 129 | 130 | 130 | 131 | 131 | 132 | 132 | 133 | 133 | 134 | 134 | 135 | 135 | |
| 136 | 136 | 137 | 137 | 138 | 138 | 139 | 139 | 140 | 140 | 141 | 141 | 142 | 142 | 143 | 143 | |
| 144 | 144 | 145 | 145 | 146 | 146 | 147 | 147 | 148 | 148 | 149 | 149 | 150 | 150 | 151 | 151 | |
| 152 | 152 | 153 | 153 | 154 | 154 | 155 | 155 | 156 | 156 | 157 | 157 | 158 | 158 | 159 | 159 | |
| 160 | 160 | 161 | 161 | 162 | 162 | 163 | 163 | 164 | 164 | 165 | 165 | 166 | 166 | 167 | 167 | |
| 168 | 168 | 169 | 169 | 170 | 170 | 171 | 171 | 172 | 172 | 173 | 173 | 174 | 174 | 175 | 175 | |
| 176 | 176 | 177 | 177 | 178 | 178 | 179 | 179 | 180 | 180 | 181 | 181 | 182 | 182 | 183 | 183 | |
| 184 | 184 | 185 | 185 | 186 | 186 | 187 | 187 | 188 | 188 | 189 | 189 | 190 | 190 | 191 | 191 | |
| 192 | 192 | 193 | 193 | 194 | 194 | 195 | 195 | 196 | 196 | 197 | 197 | 198 | 198 | 199 | 199 | |
| 200 | 200 | 201 | 201 | 202 | 202 | 203 | 203 | 204 | 204 | 205 | 205 | 206 | 206 | 207 | 207 | |
| 208 | 208 | 209 | 209 | 210 | 210 | 211 | 211 | 212 | 212 | 213 | 213 | 214 | 214 | 215 | 215 | |
| 216 | 216 | 217 | 217 | 218 | 218 | 219 | 219 | 220 | 220 | 221 | 221 | 222 | 222 | 223 | 223 | |
| 224 | 224 | 225 | 225 | 226 | 226 | 227 | 227 | 228 | 228 | 229 | 229 | 230 | 230 | 231 | 231 | |
| 232 | 232 | 233 | 233 | 234 | 234 | 235 | 235 | 236 | 236 | 237 | 237 | 238 | 238 | 239 | 239 | |
| 240 | 240 | 241 | 241 | 242 | 242 | 243 | 243 | 244 | 244 | 245 | 245 | 246 | 246 | 247 | 247 | |
| 248 | 248 | 249 | 249 | 250 | 250 | 251 | 251 | 252 | 252 | 253 | 253 | 254 | 254 | 255 | 255 | |

APPENDIX F

SPIN IMBALANCE REDUCTION WAVEFORM

| | | | | | | | | | | | | | | | | |
|---|---|---|---|---|---|---|---|---|---|---|---|---|---|---|---|---|
| 135 | 141 | 145 | 149 | 152 | 156 | 160 | 164 | 168 | 171 | 175 | 179 | 183 | 187 | 187 | 189 | |
| 191 | 192 | 193 | 193 | 194 | 194 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 195 | |
| 195 | 195 | 195 | 195 | 195 | 195 | 195 | 195 | 195 | 195 | 195 | 195 | 195 | 195 | 195 | 194 | |
| 194 | 193 | 193 | 192 | 191 | 189 | 187 | 174 | 165 | 157 | 149 | 141 | 135 | 121 | 115 | 111 | |
| 107 | 104 | 100 | 96 | 92 | 88 | 84 | 81 | 77 | 73 | 69 | 68 | 66 | 64 | 63 | 62 | |
| 62 | 61 | 61 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 60 | 60 | 60 | 60 | 60 | 60 | 60 | 60 | 60 | 60 | 60 | 60 | 60 | 60 | 60 | |
| 60 | 61 | 61 | 62 | 62 | 63 | 64 | 66 | 68 | 74 | 82 | 90 | 99 | 107 | 115 | 121 | |

What is claimed is:

1. A fabric washing machine comprising:

a rotatable container to receive fluid and fabrics to be washed in the fluid;

fluid supply means to introduce fluid into said container;

drain means to remove fluid from said container;

agitation means adapted to contact fabrics in said container:

an electronically commutated motor and means connecting said motor to selectively oscillate said agitation means for washing operation and rotate said container for centrifugal extraction operation; said motor including a stator with a plurality of energizable stator phases and a rotor with a plurality of rotor phases; and control means connected to provide commutation signals to said motor to energize said stator phases in a predetermined sequence as corresponding ones of said rotor phases approach the stator phase being energized so that said rotor rotates; said control means being effective to stop operation of said motor by repeatedly sensing the instantaneous alignment of said stator and rotor phases, supplying commutation signals to said motor to energize said stator phases in said predetermined sequence as corresponding ones of said rotor phases have become aligned with the stator phase being energized.

2. A washing machine as set forth in claim 1, wherein: said control means is effective to repeatedly sense the instantaneous angular speed of said motor and, each time the sensed speed is a predetermined increment less than the previously sensed speed at which the level of the commutation signals was set, to set the level of future commutation signals based upon the latest sensed speed.

3. A washing machine as set forth in claim 2, wherein said control is effective, upon said motor speed reaching a predetermined low value, to continuously supply commutation signals energizing one phase of said motor until motor rotation stops.

4. The washing machine as set forth in claim 2, wherein: said control is effective to determine which of a washing operation and a centrifugal extraction operation is in progress and to use a predetermined increment of sensed speed reduction between successive changes in the level of commutation signals based upon which operation is being stopped.

* * * * *